US008749394B2

(12) United States Patent
Lewis et al.

(10) Patent No.: US 8,749,394 B2
(45) Date of Patent: Jun. 10, 2014

(54) SYSTEM AND METHOD FOR EFFICIENTLY GENERATING AUDIBLE ALARMS

(75) Inventors: James J. Lewis, Oklahoma City, OK (US); Landgrave T. Smith, Oklahoma City, OK (US); David E. Albert, Oklahoma City, OK (US)

(73) Assignee: InnovAlarm Corporation, Oklahoma City, OK (US)

( * ) Notice: Subject to any disclaimer, the term of this patent is extended or adjusted under 35 U.S.C. 154(b) by 935 days.

(21) Appl. No.: 12/703,001

(22) Filed: Feb. 9, 2010

(65) Prior Publication Data

US 2011/0095896 A1 Apr. 28, 2011

Related U.S. Application Data

(60) Provisional application No. 61/254,540, filed on Oct. 23, 2009.

(51) Int. Cl.
*G08B 25/08* (2006.01)

(52) U.S. Cl.
USPC ..... 340/632; 340/628; 181/153

(58) Field of Classification Search
USPC ..... 340/628, 531, 985, 632; 181/153; 363/41; 323/207; 361/91.1; 73/646; 307/165; 708/300
See application file for complete search history.

(56) References Cited

U.S. PATENT DOCUMENTS

| | | | | |
|---|---|---|---|---|
| 3,802,535 | A * | 4/1974 | Peake et al. | 73/646 |
| 4,282,520 | A | 8/1981 | Shipp et al. | |
| 4,417,235 | A * | 11/1983 | Del Grande | 340/531 |
| 5,594,422 | A * | 1/1997 | Huey et al. | 340/628 |
| 5,614,811 | A * | 3/1997 | Sagalovich et al. | 323/207 |
| 5,625,338 | A | 4/1997 | Pildner et al. | |
| 5,710,395 | A * | 1/1998 | Wilke | 181/153 |
| 5,990,797 | A * | 11/1999 | Zlotchenko et al. | 340/628 |
| 6,028,755 | A * | 2/2000 | Saeki et al. | 361/91.1 |
| 6,150,943 | A | 11/2000 | Lehman et al. | |
| 6,404,655 | B1 * | 6/2002 | Welches | 363/41 |
| 6,646,548 | B2 | 11/2003 | Dornfeld | |
| 6,658,123 | B1 | 12/2003 | Crutcher | |
| 7,170,404 | B2 | 1/2007 | Albert et al. | |
| 7,804,964 | B2 | 9/2010 | Schreiber | |
| 2006/0139153 | A1 | 6/2006 | Adelman et al. | |
| 2007/0001825 | A1 | 1/2007 | Roby et al. | |
| 2007/0146127 | A1 | 6/2007 | Stilp et al. | |

OTHER PUBLICATIONS

International Search Report and Written Opinion mailed Feb. 11, 2011, in related International Application No. PCT/US2010/053630.

(Continued)

*Primary Examiner* — Steven Lim
*Assistant Examiner* — Kaleria Knox
(74) *Attorney, Agent, or Firm* — Knobbe, Martens, Olson & Bear, LLP

(57) ABSTRACT

Various inventive features are disclosed for efficiently generating regulation-compliant audible alerts, including but not limited to 520 Hz square wave alert/alarm signals, using an audio speaker. One such feature involves the use of a non-linear amplifier in combination with a voltage boost regulator to efficiently drive the audio speaker. Another feature involves speaker enclosure designs that effectively boost the output of the audio speaker, particularly at relatively low frequencies. These and other features may be used individually or combination in a given alarm-generation device or system to enable regulation-compliant audible alerts to be generated using conventional batteries, such as AA alkaline batteries. Various examples of efficiently generated regulation-compliant audible alerts and further enhancing such audible alerts by utilizing speaker enclosure designs are provided.

35 Claims, 23 Drawing Sheets

(56) References Cited

OTHER PUBLICATIONS

Motorola. Motorola/CTS Piezo Tweeter KNS1142A Jun. 21, 2008. Retrieved from the internet on Feb. 2, 2011 at: http://web.archive.org/web/20080621170306/http://ww.adelcom.net/MOTOROLA_ksn1142a.htm.

Motorola. Motorola/CTS Piezo Tweeter KSN1188A Jun. 21, 2008. Retrieved from the internet on Feb. 2, 2011 at: http://web.archive.org/web/20080609165802/http://www.adelcom.net/MOTOROLA_KSN1188A.htm.

International Search Report and Written Opinion mailed Mar. 22, 2011, in related International Application No. PCT/US2010/053630.

* cited by examiner

| FIG. 3A | FIG. 3B |
|---|---|

| FIG. 4A | FIG. 4B |
|---|---|

520Hz Smoke Alarm ASIC (6V)

SYSTEM AND METHOD FOR EFFICIENTLY GENERATING AUDIBLE ALARMS

CROSS-REFERENCE TO RELATED APPLICATIONS

This application claims the benefit of priority under 35 U.S.C. §119(e) to U.S. Provisional Application No. 61/254,540, filed on Oct. 23, 2009, entitled, "SYSTEM AND METHOD FOR EFFICIENTLY GENERATING AUDIBLE ALARMS," the entirety of which is incorporated herein by reference.

BACKGROUND

1. Technical Field

The present disclosure generally relates to generating audible signals, and more particularly, to systems, methods and physical structures for efficiently generating audible signals by or in connection with hazard detectors such as smoke detectors and carbon monoxide detectors.

2. Description of the Related Art

A variety of commercially available detector/alert devices exist for alerting individuals of the presence of smoke, heat, and/or carbon monoxide. These devices are typically designed to be mounted to the ceiling in various rooms of a house or other building, and are ordinarily powered by the building's AC power lines with battery backup. The audible alert signals generated by such devices are governed by various standards and regulations such as Underwriters Laboratories (UL) 217 ("The Standard of Safety for Single and Multiple Station Smoke Alarms"), UL 464 ("The Standard of Safety for Audible Signal Appliances"), UL 1971 ("The Standard for Signaling Devices for the Hearing Impaired"), and UL 2034 ("The Standard of Safety for Single and Multiple Station Carbon Monoxide Alarms").

According to these and other standards, typical smoke, fire, and carbon monoxide detectors produce a 3100-3200 Hz pure tone alert signal with the intensity (or power) of 45 to 120 dB (A-weighted for human hearing). The alert signals typically have either a repeated temporal-three (T3) pattern (three beeps followed by a pause) or a repeated temporal-four (T4) pattern (four beeps followed by a pause), and are generated using a piezoelectric device. Studies have shown that the 3100-3200 Hz alert signals generated by existing detector/alert devices are sometimes inadequate for alerting certain classes of individuals. These include children, heavy sleepers, and the hearing impaired.

Various fire alarm signal studies commissioned by the U.S. Fire Administration and Fire Protection Research Foundation have demonstrated that a 520 Hz square-wave signal is more effective at waking children, heavy sleepers and people with hearing loss than current alarms that use a 3100-3200 Hz pure tone alert signal. Accordingly, new regulations may soon require the use of a relatively low-frequency (520 Hz) square-wave alert signal, or a signal with similar characteristics, for fire alarms installed in residential bedrooms of those with mild to severe hearing loss, and in commercial sleeping rooms.

SUMMARY

Various inventive features are disclosed for efficiently generating regulation-compliant audible alerts, including but not limited to 520 Hz square wave alert/alarm signals, using an audio speaker. One such feature involves the use of a non-linear amplifier in combination with a voltage boost regulator to efficiently drive the audio speaker. Another feature involves speaker enclosure designs that effectively boost the output of the audio speaker, particularly at relatively low frequencies. These and other features may be used individually or combination in a given alarm-generation device or system to enable regulation-compliant audible alerts to be generated using conventional batteries, such as AA alkaline batteries.

In certain embodiments, such efficient generation of regulation-compliant audible alerts can be achieved by an alarm system having a voltage boost regulator and a non-linear amplifier. In response to detection of an alarm condition a signal such as a square wave signal can be generated and provided to the non-linear amplifier. The signal provided to the non-linear amplifier can be boosted by the voltage boost regulator so that a voltage level of the signal supplied to the non-linear amplifier is increased to at least a threshold level. The amplified output signal from the non-linear amplifier is provided to a speaker or a speaker assembly so as to generate an audible alert signal having a desired frequency such as at or near 520 Hz.

In certain embodiments, an electrical output signal having a frequency such as about 520 Hz and resulting from detection of an alarm condition is provided to a speaker coupled to an enclosure. The speaker/enclosure assembly can be configured to have a fundamental resonance frequency that is substantially equal to the electrical output signal frequency, such that the speaker assembly as a whole generates an audible alert signal having an enhanced intensity at or near its fundamental frequency.

Nothing in the foregoing summary or the following detailed description is intended to imply that any particular feature, characteristic, or component of the disclosed devices is essential.

BRIEF DESCRIPTION OF THE DRAWINGS

These and other features will now be described with reference to the drawing summarized below. These drawings and the associated description are provided to illustrate specific embodiments, and not to limit the scope of the scope of protection.

FIGS. 23A and 23B are obtained and compared for different lengths of the enclosure of the speaker assembly of FIG. 21A.

DETAILED DESCRIPTION OF CERTAIN EMBODIMENTS

Figure 1A:
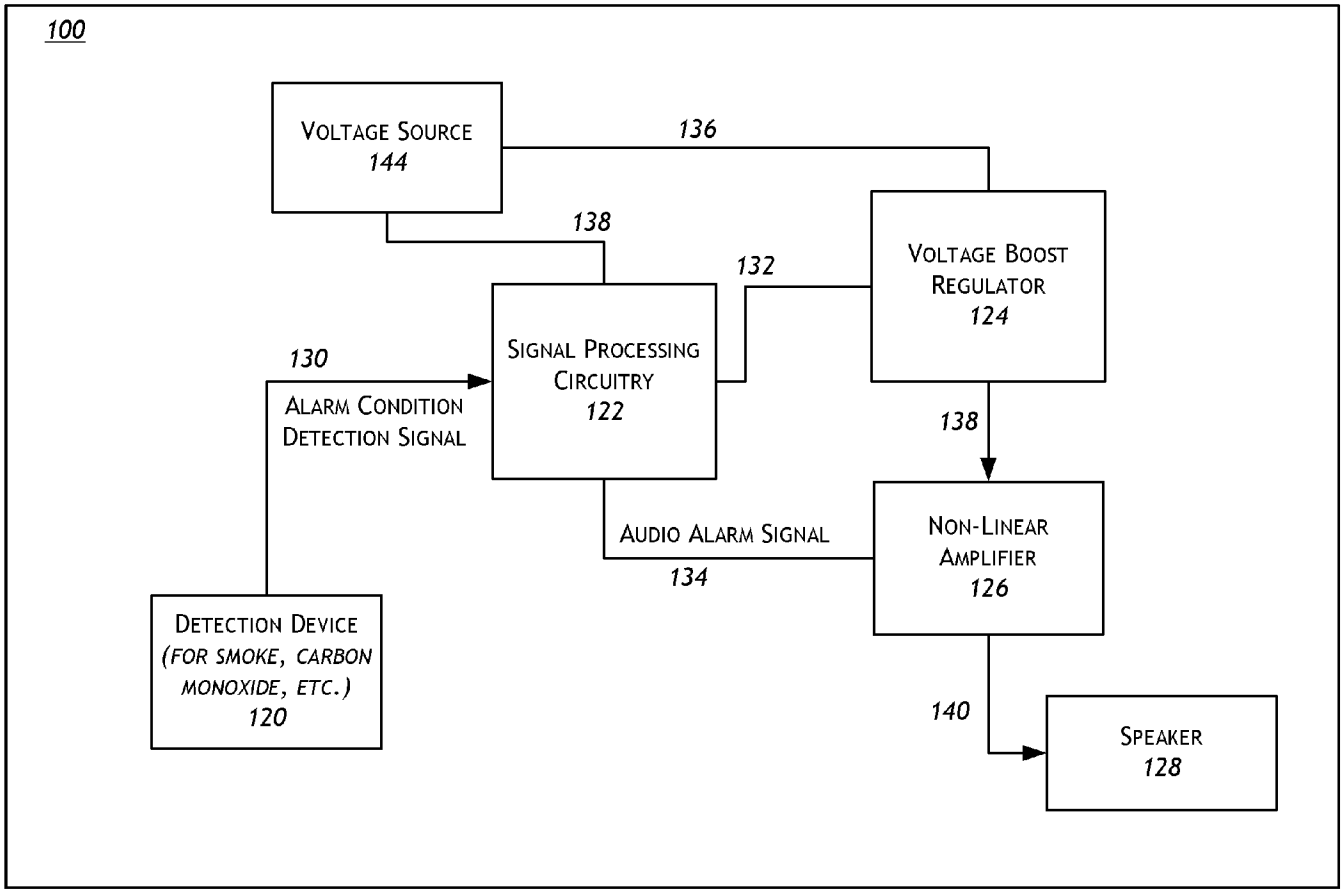
FIG. 1A is a block diagram that illustrates a system for efficiently generating audible alerts in accordance with one embodiment.

Various inventive features are disclosed for efficiently generating regulation-compliant audible alerts, including but not limited to 520 Hz square wave alert/alarm signals, using an audio speaker. One such feature involves the use of a non-linear amplifier in combination with a voltage boost regulator to efficiently drive the audio speaker. Another feature involves speaker enclosure designs that effectively boost the output of the audio speaker, particularly at relatively low frequencies. These and other features may be used individually or combination in a given alarm-generation device or system to enable regulation-compliant audible alerts to be generated using conventional batteries, such as AA alkaline batteries.

For purposes of illustrating specific embodiments, the systems and methods are described in the context of an alarm system that efficiently generates a low-frequency audible alarm signal using power from commonly available batteries at a rate that preserves battery life for at least one year, as required by existing codes, such as those from the Underwriters Laboratory (UL), American National Standards Institute (ANSI), and National Fire Protection Association (NFPA). As will be recognized, the inventive circuits, methods and speaker enclosures disclosed herein are not limited to the specific regulations referenced herein or to the requirements specified by such regulations. Thus, these regulations are not intended as a limitation on the scope of the protection.

For purposes of illustration, the various alarm-generation features are described herein primarily in the context of ceiling-mounted detector/alert devices or systems capable of detecting smoke, heat, carbon monoxide, or some combination thereof. However, the disclosed features can also be incorporated into other types of devices that generate audible alarms. For example, the disclosed features can be embodied in a supplemental alert generation device which listens for a conventional smoke and/or carbon monoxide detector to generate is standard alarm signal (typically a 3100 to 3200 Hz pure tone signal), and which responds by supplementing the detected alarm with a relatively low frequency (e.g., 520 Hz square wave) audible alert signal. Examples of such supplemental alert generation devices are disclosed in a U.S. patent application Ser. No. 12/703,097 titled "Supplemental alert generation device", which is being filed on the same day as the present application (Feb. 9, 2010) and which is hereby incorporated herein by reference.

The detection/alert devices described herein may be powered by a standard 120 volt, 60 herz AC power source with a battery backup. Because such devices typically must be capable of generating regulation-compliant audible alarm signals for extended time periods when AC power is lost, the efficiency of the underlying circuitry is very important. Thus, aspects of this disclosure focus on circuits, methods and structures for efficiently generating audible alert signals using conventional batteries.

FIG. 1A illustrates a system 100 for detecting and alerting individuals to various types of alarming condition according to certain embodiments. The system 100, which may be in the form of a standard sized detection/alert device or "alarm" that attaches to the ceiling, comprises a detection device 120 that is configured to detect an alarming condition such as the presence of smoke or carbon monoxide. The system 100 also includes signal processing circuitry 122, a voltage boost regulator 124, and an efficient, non-linear audio amplifier 126 that outputs an amplified signal to an audio speaker 128. The system draws power from a voltage source 144, such as a battery or set of batteries. The detection device 120 may comprise circuitry and other components for detecting smoke, heat, and/or carbon monoxide. The signal processing circuitry 122 is coupled to and controls the voltage boost regulator 124 and the non-linear audio amplifier 126. The signal processing circuitry 122 can, for example, be implemented using a microcontroller, a digital signal processor, a microprocessor, an Application-Specific Integrated Circuit (ASIC), a Field Programmable Gate Array (FPGA), or some combination thereof. The signal processing circuitry 122 generates an audio alarm signal, such as a 520 Hz square wave signal, that is fed to the non-linear amplifier 126. This square wave signal may be cycled on and off to create a Temporal-3 (T3) or Temporal-4) pattern.

In one embodiment, signal processing circuitry 122 is implemented using a MSP430 microcontroller manufactured by Texas Instruments. One property of the MSP430 family is that it has a very low power consumption both in standby mode (0.1 microamps per second) and active mode (300 microamps per second). This property, along with the 16-bit width of its arithmetic logic unit (ALU) makes it a good candidate for the range of detectors from simple ionization and photoelectric smoke alarms to more complex carbon monoxide alarms. The use of microcontroller family no. MSP430 in an example alarm application is described in the application report no. SLA355, dated October 2006, entitled "Implementing a Smoke Detector with the MSP430F2012," authored by Mike Mitchell of Texas Instruments, the disclosure of which is hereby incorporated by reference. Those skilled in the art will recognize that other microcontrollers with similar low power consumption and/or ALU properties can also be used in various embodiments.

In one embodiment, the signal processing circuitry 122 is configured to receive an alarm condition detection signal from the detection device 120 via a signal line 130. The signal processing circuitry 122, for example, may be configured to instruct the detection device 120 to periodically sample a sensor (e.g., a photoelectric, ionization, air-sampling, and the like) that detects the presence of smoke or carbon monoxide or any other alarming condition. The signal processing circuitry 122 may be programmed to distinguish false positive signals from the detection device 120. For example, the signal processing circuitry 122 may include logic that generates an audible alarm after an alarming condition is detected and/or reported by the detection device 120 in several consecutive samples.

Once an alarming condition is determined to be present, the signal processing circuitry 122 is configured to generate an output audio signal to the non-linear audio amplifier 126 via a signal line 134. In one embodiment, the non-linear audio amplifier 126 is or comprises a Class D audio amplifier. Class D amplifiers are efficient because they use the switching mode of transistors to operate in the non-linear range, which results in low energy losses (i.e., less power is dissipated as heat). As will be recognized by a skilled artisan, the amplifier 126 can be another type of an efficient, non-linear amplifier. The signal processing circuitry 122 is also configured in one embodiment to control, via a signal line connection 132, the voltage boost regulator 124 such that the voltage supplied to the non-linear audio amplifier 126 is increased to at least a threshold voltage sufficient to produce an audio signal that is at least 85 dBA as measured 10 feet from the alarm 100. The voltage boost regulator 124 can be an efficient (i.e., low power) DC to DC converter. The preferred voltage ranges for the threshold voltage will be further discussed in the next section below.

During the alarm sounding periods, the non-linear amplifier 126, which may be a Class D audio amplifier in one embodiment, is configured to output the amplified audio alert signal generated by the signal processing circuitry 122 to the speaker 128 via a connection 140. The generated audio alert signal from the signal processing circuitry 122 may have a frequency in a range of about 30 Hz to 1050 Hz, more preferably about 300 Hz to 700 Hz, yet more preferably about 400 Hz to 600 Hz, yet more preferably about 470 Hz to 570 Hz, yet more preferably about 500 Hz to 540 Hz. In certain embodiments, the frequency is at or near about 520 Hz. In certain embodiments, the audio signal generated in the foregoing manner preferably has a square wave sound pattern. In one embodiment, the non-linear amplifier 126 is powered by voltage output from the voltage boost regulator 124 through a connection 138.

Figure 1B:
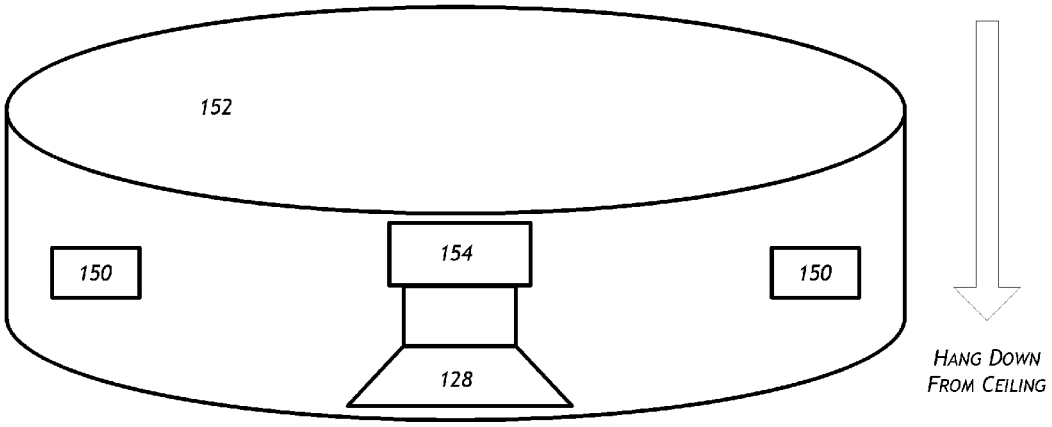
FIG. 1B illustrates the placement of a speaker in an alarm system in accordance with one embodiment.

In the physical implementation of the alarm, the speaker 128 is preferably sealed in the back (the end opposite to where sound is projected) to prevent smoke or carbon monoxide from getting drawn into the speaker and blown out by it on the other end. As shown in FIG. 1B, in one embodiment, the speaker 128 faces downward (vertically) from the ceiling where the alarm is installed, with the smoke vents 150 of the alarm housing 152 oriented horizontally to draw smoke away from the speaker 128. A seal 154 covers the back of the speaker 128. In certain embodiments, such sealing of the speaker 128 can be facilitated by an enclosure configured such that sound output by the speaker and the enclosure in combination has an enhanced intensity at a desired frequency. Various examples of such an intensity-enhancing speaker and enclosure assembly are described below with reference to FIGS. 6-28.

Efficiency

As discussed above, existing regulations for standalone alert devices such as smoke alarms and carbon monoxide alarms require an output of 85 dBA measured at a distance of 10 ft. Existing UL regulations also require such alarms to operate at an efficiency that enables common household batteries to last for at least one year before they are exhausted.

Because the audio frequency for the alarm signal was not specified until recently, most conventional smoke alarms achieve battery compliance by using piezoelectric elements at their respective resonant frequency (approximately 3000 Hz) in order to gain mechanical advantage and to produce 85 dBA audible alert measured at 10 ft and to meet the longevity requirements.

When using a speaker to generate sound, output sound intensity is related to the electrical power driven into it. An increase in electrical power increases the sound intensity. Electrical power can be calculated by the equation:

$$P = \frac{V_{RMS}^2}{R}$$

where P is Power, V is voltage, and R is impedance of the speaker. Typical speaker impedance is 8Ω. So in order to increase intensity, voltage is typically increased.

Because most alarms are installed as standalone devices, they are preferably battery powered. Moreover, the size of commercially available detectors is advantageously small. Current smoke and carbon monoxide detectors use either 9V batteries, AA alkaline batteries (in twos, threes, or fours), or lithium batteries (e.g., CR123A). Consumers generally expect alarm devices to use these or similar batteries. Although 9V batteries have a relatively high voltage, they have very little current output capabilities and are thus largely unsuitable for powering an audio circuit capable of producing a 520 Hz square wave at 85 dBA measured at 10 ft. Therefore, in one embodiment, one or more AA batteries are used as the voltage source 144. AA batteries are preferably used because, as mentioned above, they are generally available to consumers and have the ability to provide the current necessary to power the system. In addition, AA batteries tend to be smaller than C or D batteries and can thus fit into the housing used in conventional alarms. However, in various embodiments, C or D batteries may be used where the housing can accommodate the sizes of these batteries. Since each typical AA battery provides 1.5V, a single AA battery can only provide a maximum of two times its voltage to a speaker (3V). Two AA batteries can thus provide 2×(2×1.5)V or 6V, peak to peak. Four AA batteries can provide 2×(4×1.5)V or 12V, peak to peak.

Since the root mean square (RMS) voltage of a square wave is equal to its peak value, two AA batteries can ideally provide $$P = \frac{V_{RMS}^2}{R} = \frac{3^2}{8} = \frac{9}{8} = 1.125 \text{ W}$$

Four AA batteries can ideally provide $$P = \frac{V_{RMS}^2}{R} = \frac{6^2}{8} = \frac{36}{8} = 4.5 \text{ W}$$

As shown, power increases in proportion to square of voltage.

The speaker size in various alarm embodiments is chosen based on the observation that the larger the diameter of the speaker, the more sound output it has at low frequencies. The speaker preferably has a diameter of 3 inches or less so that it can fit in standard size enclosures commonly used for existing (piezo-based) alarms. Also, the speaker is preferably large enough (e.g., 2.5 inches or above) to be able to efficiently generate the low frequency components of a 520 Hz square wave. Thus, for example, the speaker 128 may be a relatively inexpensive 3-inch or 2.5-inch audio speaker available from a variety of manufactures. Other speaker sizes are also possible (e.g., 2 inches or 1.5 inches).

In one or more embodiments, the system preferably provides enough power to output a compliant audio alert signal (85 dBA at 10 ft), while keeping within the speaker size and voltage source size constraints. This may be accomplished in part by using monolithic integrated circuits (ICs) that combine the voltage boost regulator 124 with the non-linear audio amplifier 126 (which comprises a Class D audio amplifier in one embodiment). One embodiment uses ICs from Texas Instruments that are designed to boost the voltage of two AA batteries from about 4V to about 5.5V. Another embodiment uses ICs from National Semiconductor that are designed to boost the voltage of four AA batteries from about 6V to about 9V. Yet another embodiment uses ICs from Texas Instruments that are designed to boost the voltage of four AA batteries from about 6V to about 7.8 V.

Output Measurements

Two of the aforementioned ICs were tested with a range of speakers to compare audio output (sound pressure level (SPL)) measured in dBA. For baseline reference, a 3V circuit was tested with a 2 inch speaker in a shielded room designed to attenuate sound (an anechoic room) and it measured an extrapolated 81.7 dBA at 10 ft. The following measurements were made in a room that is not anechoic, and can be relied upon for their relative dBA measurement as referenced to the 81.7 dBA.

The table below shows power measured from each speaker with the speaker sitting in the open (i.e., not enclosed), charting the relative SPL increase as speaker diameter increases. It also shows that the 2.5 inch speaker used is roughly equivalent to the 2 inch speaker.

| Speaker Diameter | 2" | 2.5" | 3" | 4" |
|---|---|---|---|---|
| Power (boosted) 4xAA | 83.5 dBA | 83.6 dBA | 85.3 dBA | 88.4 dBA |

The next table shows test results with different speaker sizes and drive voltages (or voltage supplied to the amplifier). The results were based on testing that mounted speakers in a sealed enclosure that likely provided some resonance of its own.

| Speaker Diameter | 2.5" | 3" |
|---|---|---|
| Power (boosted) 2xAA | 91.7 dBA | 95.3 dBA |
| Power (boosted) 4xAA | 94.7 dBA | 97.5 dBA |

The results show that increasing the drive voltage increases the sound by 2 to 3 dBA, and increasing the speaker diameter increases the sound by around 3 dBA. As shown in the above table, 97.5 dBA representative of the combination of a 3 inch speaker, powered by 4 AA batteries boosted to about 7.8V has about 6 dBA added (97.5 dBA−91.7 dBA) to the sound level as compared to the 2.5 inch speaker powered by 2 AA batteries. Given that a 81.7 dBA output was measured in an anechoic environment with the baseline 2 inch speaker and 3V input, it follows that at least 87.7 dBA (81.7 dBA+6 dBA)

can be produced by using 4 AA batteries and a 3 inch speaker. Therefore, in one embodiment, the voltage source 144 comprises 4 AA batteries and the speaker 128 comprises a 3 inch speaker.

ASIC Embodiments

Figure 2:
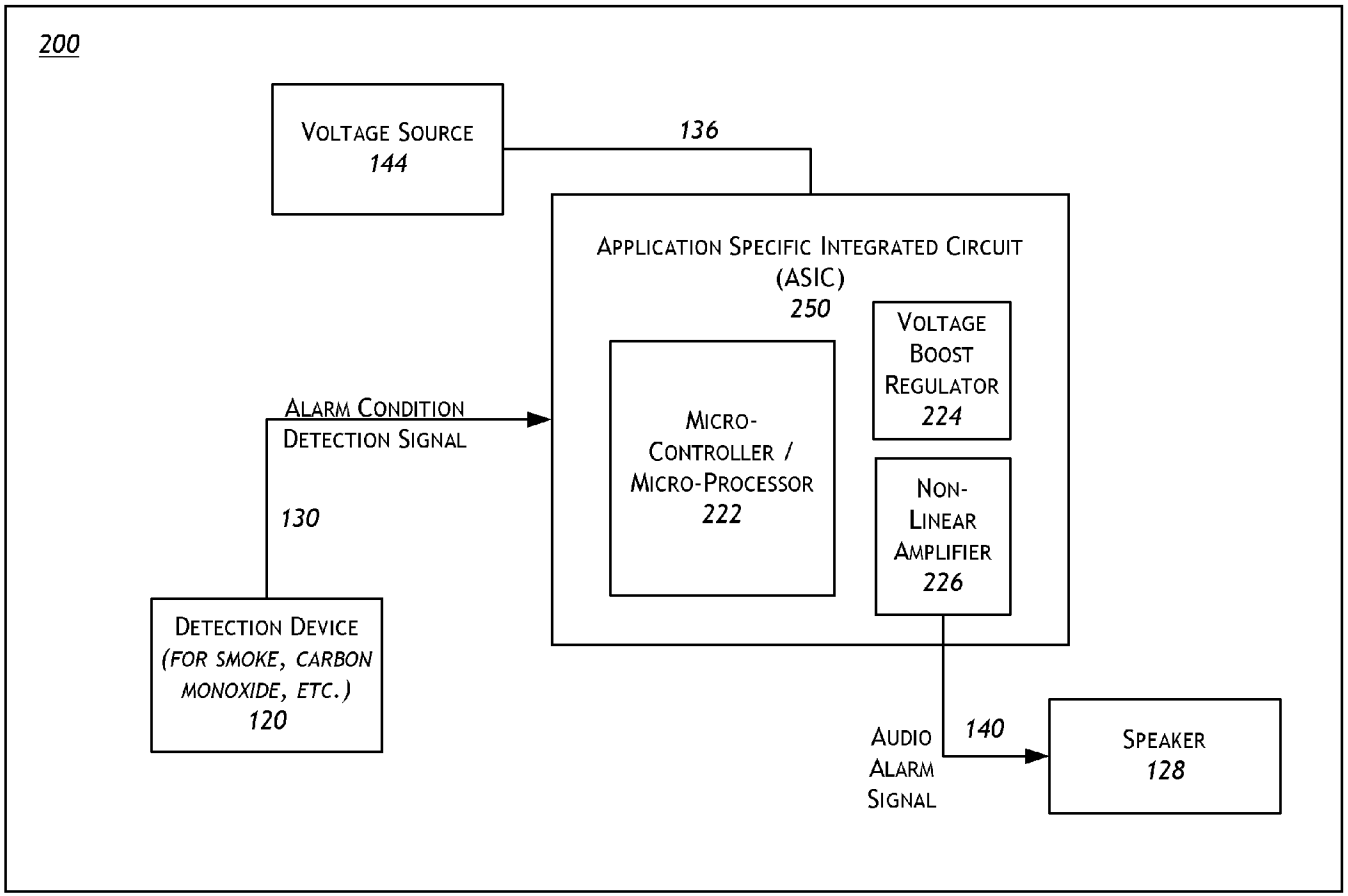
FIG. 2 is a block diagram that illustrates an alarm system with an ASIC in accordance with another embodiment.

In another embodiment, given the level of integration already achieved by combining a voltage boost regulator 124 with the non-linear amplifier 126 (e.g., a Class D amplifier), an ASIC is used to combine this functionality with a general purpose low power microcontroller such as a microcontroller in the aforementioned MSP430 family from Texas Instruments. As shown in FIG. 2, an alarm alert system 200 may comprise an ASIC 250 that provides a single integrated circuit that provides the functional equivalent of a micro-controller/micro-processor 222 and an efficient, non-linear amplifier 226 coupled with a voltage boost regulator 224. In one embodiment, the ASIC can be tailored to a wide range of applications by just changing its internal firmware code to vary the detection algorithm. Examples of detection algorithms are described in U.S. Provisional Application No. 61/229,684 (filed Jul. 29, 2009), the disclosure of which is hereby incorporated by reference. A more detailed circuit diagram of an example ASIC implementation is shown in FIG. 5 as further described below.

Circuit Diagrams

Figure 3A:
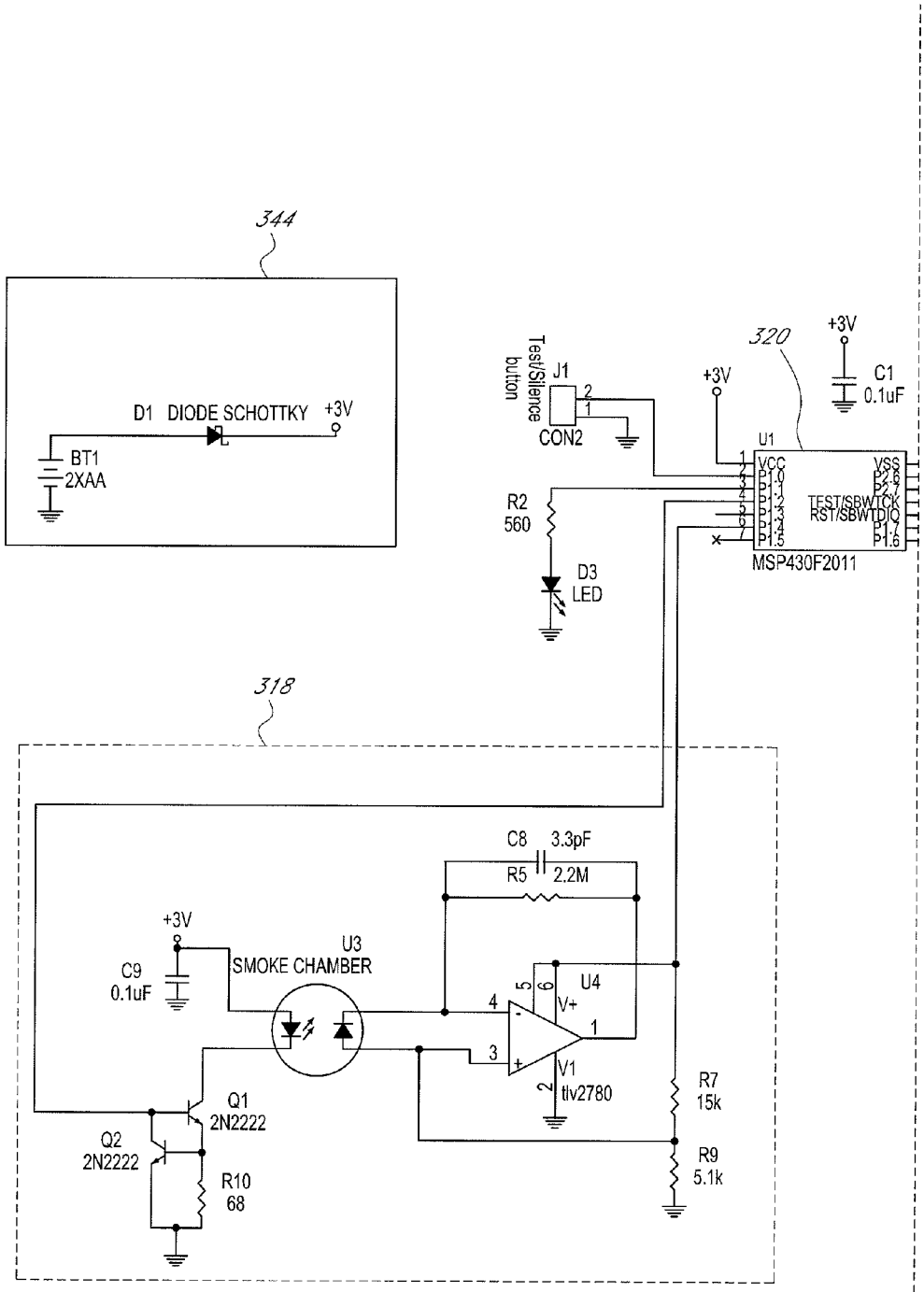
FIG. 3 is a circuit diagram that illustrates an alarm system that generates a 520 Hz signal in accordance with one embodiment.
Figure 3B:
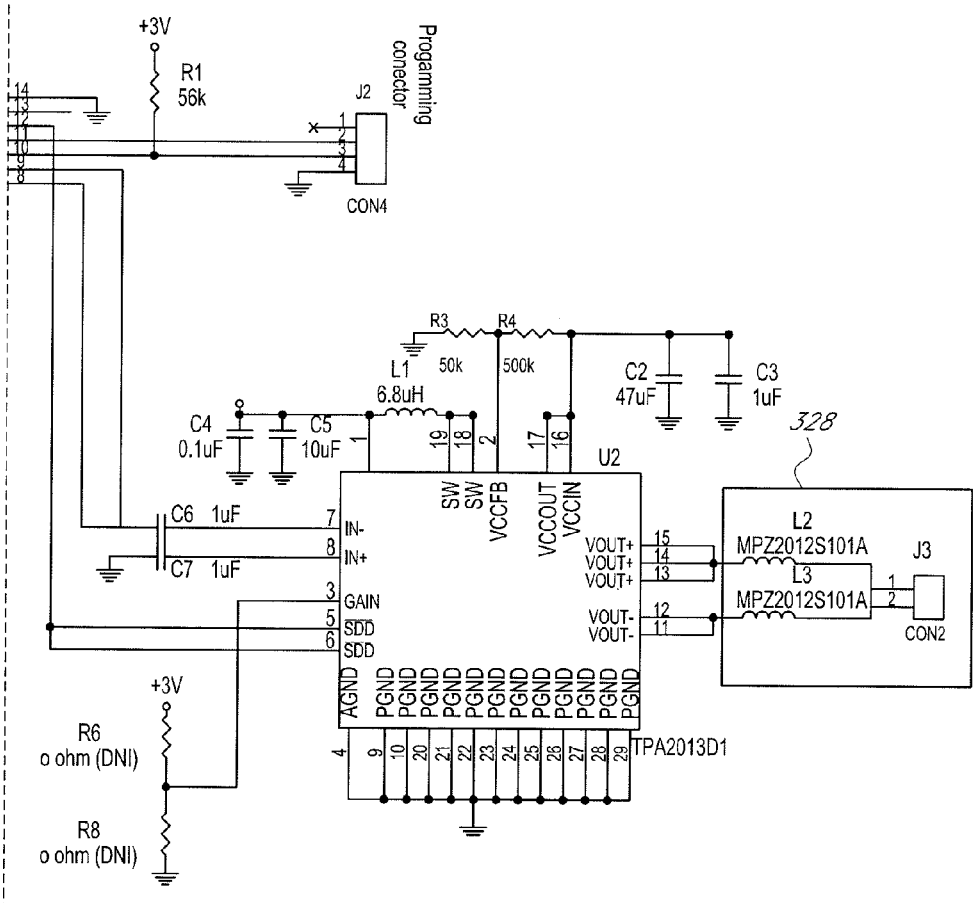
Figure 4A:
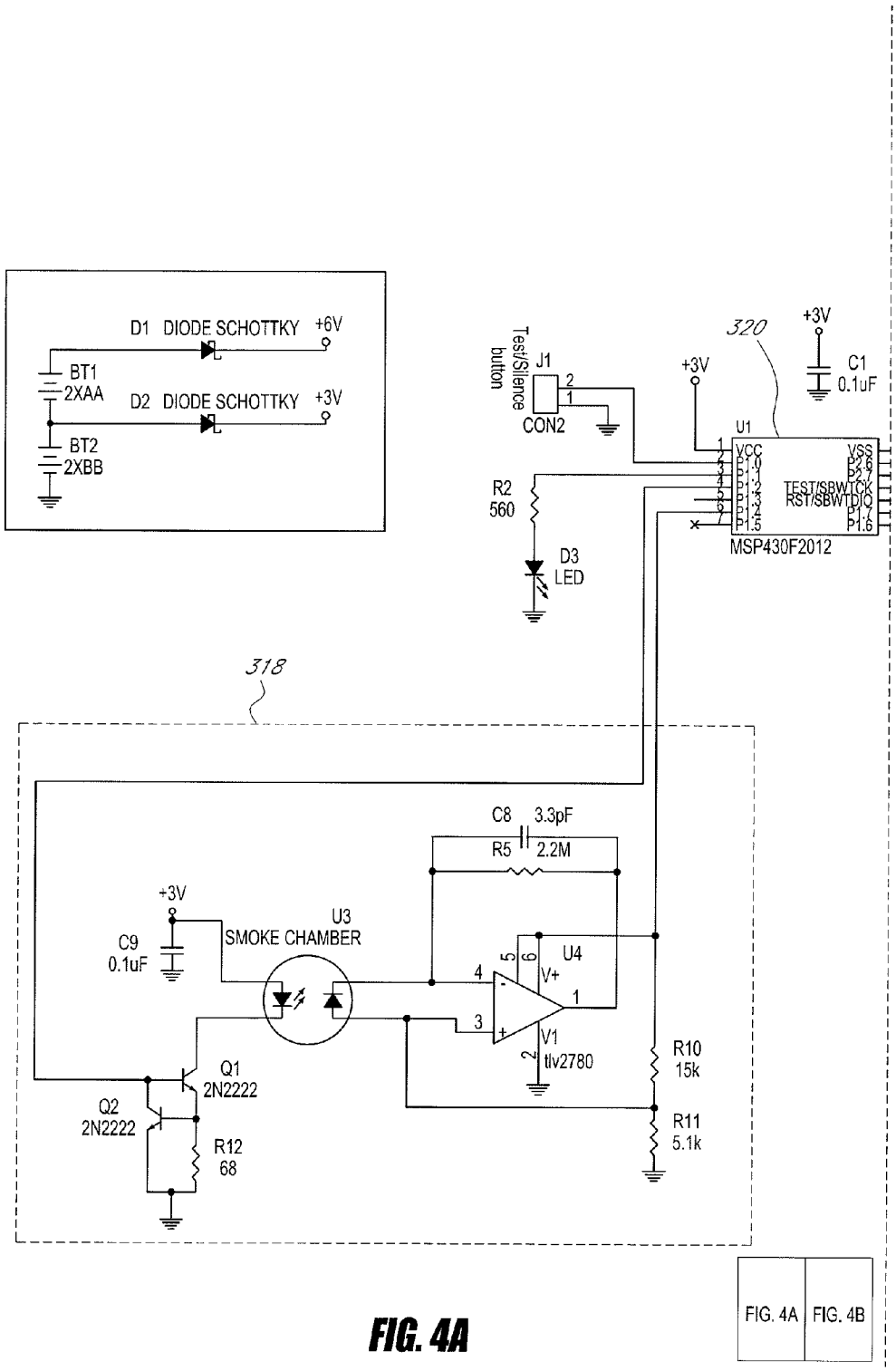
FIG. 4 is a circuit diagram that illustrates an alarm system that generates a 520 Hz signal in accordance with another embodiment.
Figure 4B:
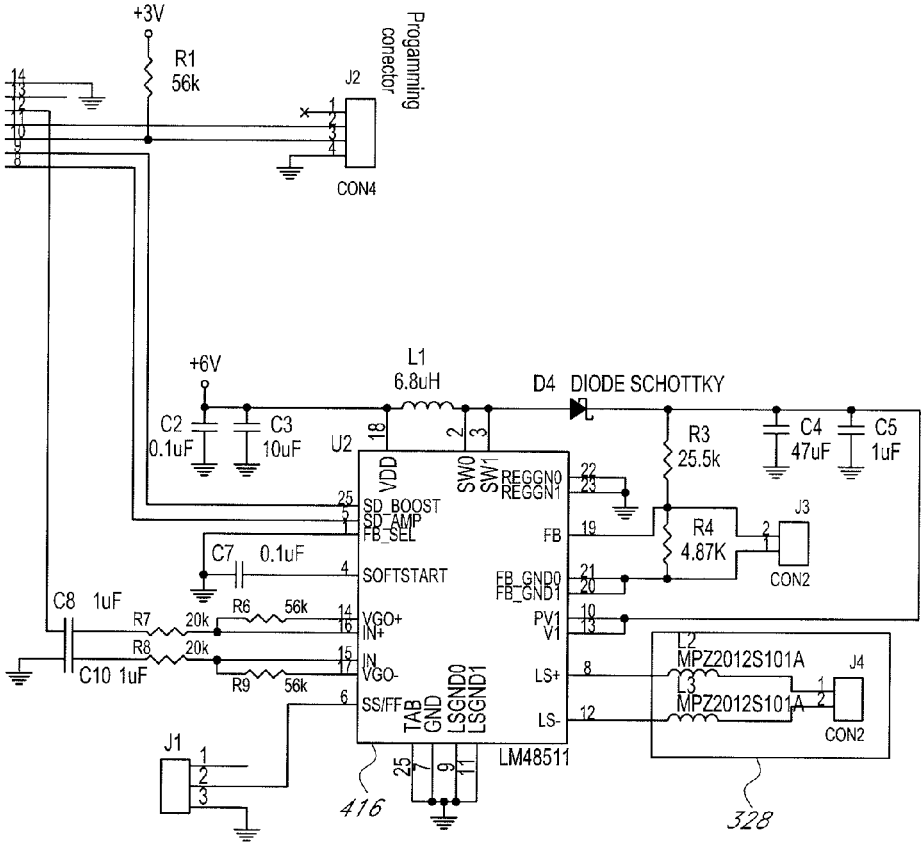
Figure 5A:
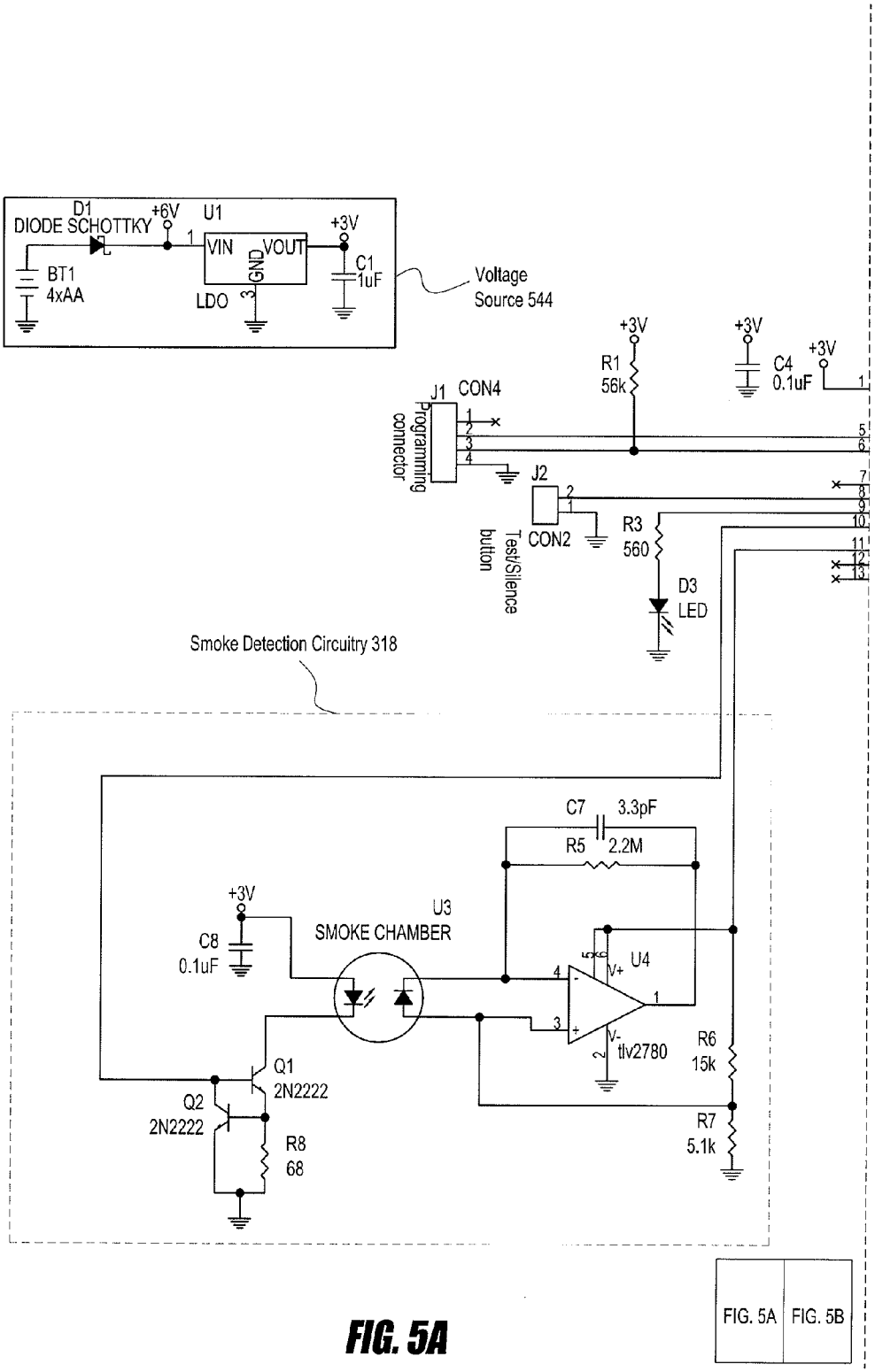
FIG. 5 is a circuit diagram that illustrates an alarm system that generates a 520 Hz signal in accordance with yet another embodiment.
Figure 5B:
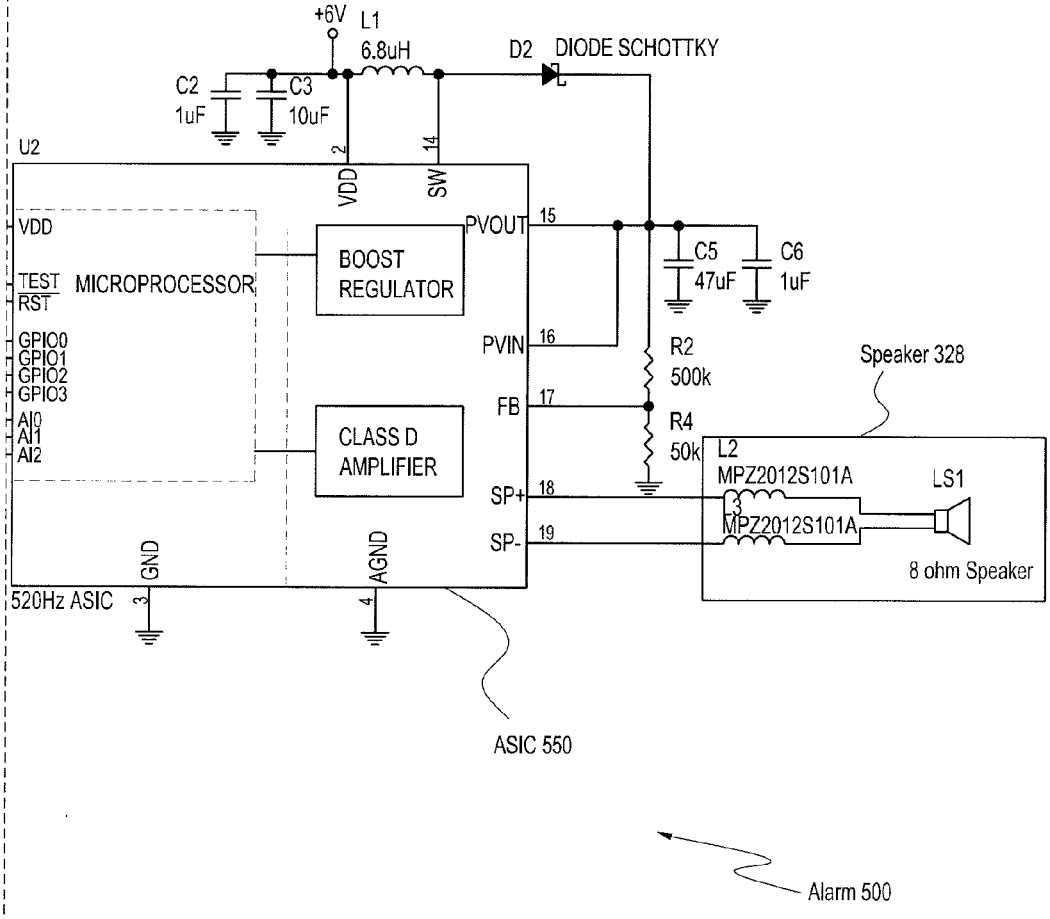

FIGS. 3-5 are circuit diagrams showing example implementations in accordance with various embodiments. FIG. 3 is a circuit diagram that shows an implementation of an alarm system 300 that is configured to generate 520 Hz T3 audible alert signal. As shown, the alarm 300 comprises a microprocessor 320, smoke detection circuitry 318, and a Class D audio amplifier with integrated voltage boost regulator 316. The components are electrically coupled as shown in the circuit diagram. In one embodiment the microprocessor is the aforementioned MSP430 family microprocessor made by Texas Instruments. The embodiment shown in FIG. 3 is powered by a voltage source 344 consisting of two AA batteries (3V) connected in series. The voltage is boosted to a threshold voltage (e.g., 5.5V) sufficient for generating an audible alert signal of 85 dBA intensity measured at 10 ft by the voltage boost regulator that is integrated with the Class D audio amplifier 316. In one embodiment, the Class D audio amplifier (with integrated voltage boost regulator) 316 is the amplifier family model no. TPA2013 made by Texas Instruments. The audible alert signal generated by the microprocessor 320 and amplified by the Class D amplifier 316 is output by the speaker 328.

FIG. 4 is a circuit diagram that shows another implementation of an alarm system 400 that is configured to generate 520 Hz T3 audible alert signal. The alarm 400 comprises a microprocessor 320, smoke detection circuitry 318, and a Class D audio amplifier with integrated voltage boost regulator 416. The components are electrically coupled as shown in the circuit diagram. In one embodiment, the microprocessor is the aforementioned MSP430 family microprocessor made by Texas Instruments. The embodiment shown in FIG. 4 is powered by a voltage source 444 consisting of four AA batteries (6V). The voltage is boosted to a threshold voltage (e.g., 7.8V or 9V) sufficient for generating an audible alert signal of 85 dBA intensity measured at 10 ft by the voltage boost regulator that is integrated with the Class D audio amplifier 416. In one embodiment, the Class D audio amplifier (with integrated voltage boost regulator) 416 is the amplifier model no. LM48511 made by National Semiconductors. The audible alert signal generated by the microprocessor 320 and amplified by the Class D amplifier 416 is output by the speaker 328.

FIG. 5 is a circuit diagram that shows an ASIC implementation of an alarm system 500 that is configured to generate 520 Hz T3 audible alert signal. In one embodiment, the alarm 500 comprises an ASIC 550 and smoke detection circuitry 318. As mentioned above in conjunction with FIG. 2, the ASIC 550 is configured to provide the functionality of a microprocessor, a voltage boost regulator, and a Class D audio amplifier. The embodiment shown in FIG. 5 is powered by a voltage source 544 comprising four AA batteries (6V). The voltage is boosted to a threshold voltage (e.g., 7.8V or 9V) sufficient for generating and audible alert signal of 85 dBA intensity measured at 10 ft by the portion of the ASIC configured to provide the voltage boosting functionality. The audible alert signal generated and amplified by the ASIC 550 is output by the speaker 328.

Examples of Speaker Enclosures

As described above, certain embodiments of an alarm alert system can be configured such that a desired output signal is generated by a signal processing circuitry and provided to a speaker. In certain situations, there may be a need or desire to use readily available and/or economical speakers in such alarm alert systems. Further, it may be desirable to operate such speakers using readily available and/or economical power sources (e.g., compact batteries such as AA sized batteries).

Often, however, such design and operating parameters can be at odds with the performance of the speaker. For example, limited power from the batteries can limit loudness of a given speaker's sound output. In another example, many readily available speakers are designed to provide a relatively broad and uniform frequency response to generally accommodate typical listening situations (e.g., music for entertainment, voice recordings, etc.). When such speakers are provided with a relatively narrow frequency band signal, a desired frequency sound output is often accompanied by a number of harmonics that divert available energy to output frequencies that are not necessarily desired.

In certain embodiments as described herein, sound output from a speaker assembly can be enhanced selectively at or near a desired frequency such as the example 520 Hz. In certain embodiments, such enhancement can be implemented with speakers that are readily available, economical, and/or powered by a limited source.

Figure 6:
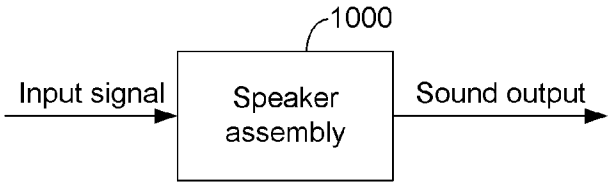
FIG. 6 schematically depicts a speaker assembly configured to receive an input signal and yield a sound output.
Figure 7:
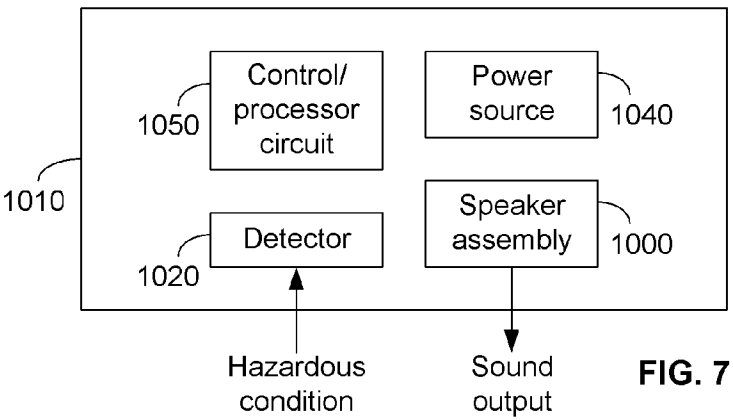
FIG. 7 schematically shows that in certain embodiments, the speaker assembly of FIG. 6 can be utilized in hazardous condition detection devices such as smoke detectors and carbon monoxide detectors.

FIG. 6 schematically depicts a speaker assembly 1000 configured to receive an input signal and yield a sound output. FIG. 7 shows that in certain embodiments, the speaker assembly 1000 can be part of an alarm alert device 1010. Such a device can include a detector 1020 configured to detect a hazardous condition such as presence of smoke or carbon monoxide gas. Processing of a signal indicative of a hazardous condition can be performed by a control/processor circuit 1050. An output from the control/processor circuit 1050 can include an alarm signal (e.g., the input signal of FIG. 6) provided to the speaker assembly 1000. In certain embodiments, a power source 1040 can provide electrical power to various components of the alarm alert device 1010, including the speaker associated with the speaker assembly 1000.

In certain embodiments, the alarm alert device 1010 can function as a supplemental device to another alarm alert device. For example, the detector 1020 can be configured to detect an audible alarm (e.g., frequency between approximately 2,900 Hz to 3,400 Hz) emitted from an existing alarm alert device upon detection of a hazardous condition (by the existing alarm alert device). Based on such an input, an output from the control/processor circuit 1050 can be generated so as to provide an alarm signal to the speaker assembly 1000.

Figure 8:
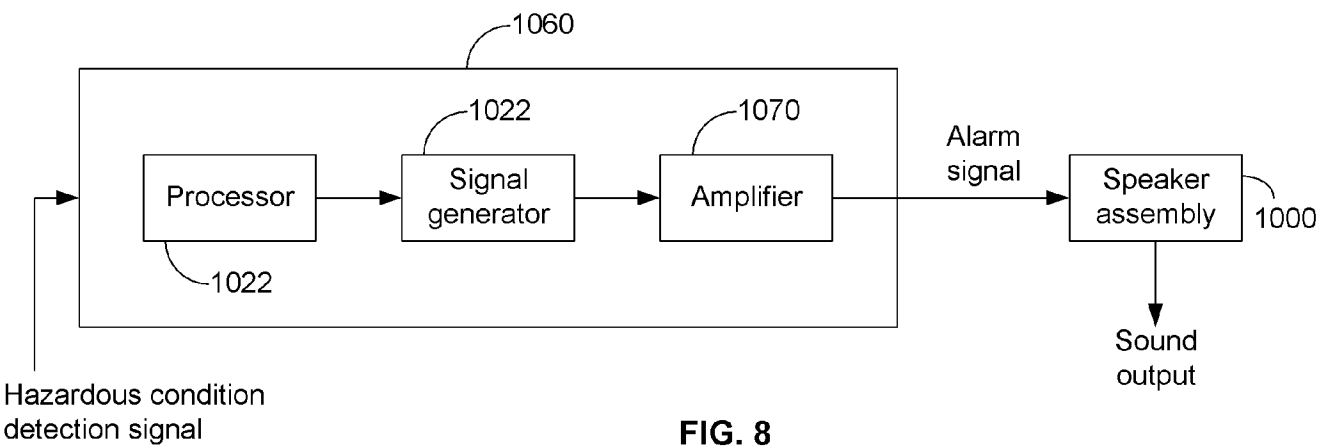
FIG. 8 schematically shows various components for a circuit configured to provide control and/or signal processing for the device of FIG. 7.

FIG. 8 shows that in certain embodiments, the control/processor circuit 1050 of FIG. 7 can be configured to receive the detection signal indicative of hazardous condition and generate the alarm signal. Such functionality can be facilitated by a processor 1002 configured to induce a signal generator 1022 to generate the alarm signal that is amplified by an amplifier 1070. The amplifier 1070 can include a linear amplifier and/or a non-linear amplifier. The alarm signal from the control/processor circuit 1050 can be provided to the speaker assembly 1000 so as to yield a sound output having one or more features as described herein.

Figure 9:
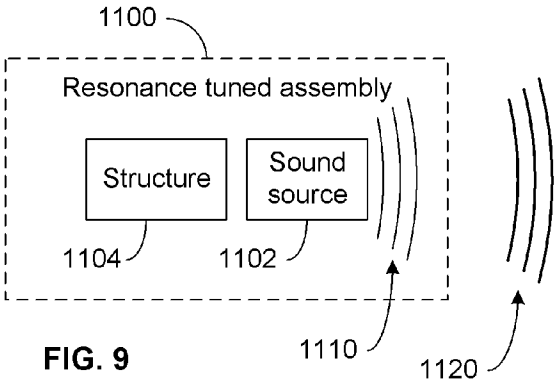
FIG. 9 schematically shows that in certain embodiments, the speaker assembly of FIGS. 6-8 can be an assembly of a sound source and a structure coupled to the sound source, where the assembly can be tuned to have a resonance frequency that is substantially same or similar to a frequency at which the sound source is being driven.

FIG. 9 shows that in certain embodiments, the speaker assembly of FIGS. 6-8 can be a resonance tuned assembly 1100 having a sound source 1102 and some structure 1104 coupled to the sound source 1102. The sound source 1102 is described herein in the context of a speaker; and the structure 1104 in the context of an enclosure. It will be understood that the resonance tuned assembly 1100 does not necessarily require a speaker to be in an enclosure. Acoustic resonance effects can be achieved without such enclosure.

In FIG. 9, the sound source 1102 is depicted as generating a sound wave pattern 1110. If the input signal is a periodic wave form, the sound wave 1110 will typically include a frequency component at or near the frequency of the input wave form. FIG. 9 further depicts a sound wave pattern 1120 generated by the resonance tuned assembly 1100 as a whole. As described herein, the resonance tuned assembly 1100 can be configured so that the sound wave pattern 1120 from the assembly 1100 includes one or more frequency components that are enhanced when compared to the sound wave pattern 1110.

Figure 10:
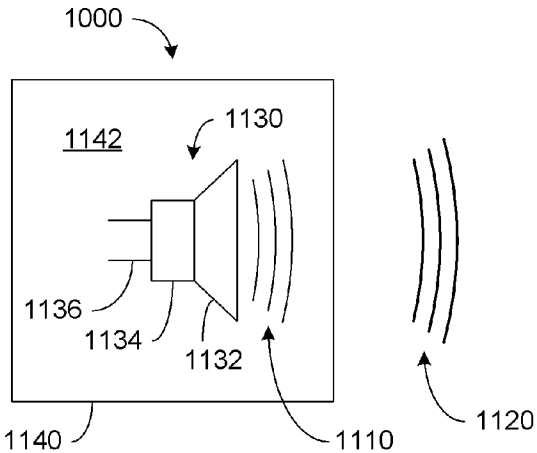
FIG. 10 schematically shows that in certain embodiments, the speaker assembly of FIG. 9 can include an audio speaker and an enclosure that encloses at least a portion of the audio speaker.

FIG. 10 shows that in certain embodiments, the resonance tuned assembly 1100 of FIG. 9 can include a loudspeaker 1130 (also frequently referred to herein as simply a speaker) that is at least partially enclosed in an enclosure structure 1140. The enclosure 1140 is depicted as defining an enclosure volume 1142.

The speaker 1130 can include a diaphragm 1130 driven by a voice coil 1134 in response to an input signal. In certain embodiments, the input signal can be provided via lead wires 1136. The speaker may, for example, be a low-cost 3-inch or 2.5-inch audio speaker available from a variety of manufactures.

In FIG. 10, the speaker 1130 is depicted as generating a sound wave pattern 1110. If the input signal is a periodic wave form, the sound wave 1110 will typically include a frequency component at or near the frequency of the input wave form. FIG. 10 further depicts a sound wave pattern 1120 generated by the speaker assembly 1000 as a whole. As described herein, the speaker assembly 1000 can be configured so that the sound wave pattern 1120 from the assembly 1000 includes one or more frequency components that are enhanced when compared to the sound wave pattern 1110.

In certain embodiments, an alarm alert system can include the speaker assembly 1000 of FIG. 10. The speaker assembly can be configured to have a resonance frequency that is within a frequency range of about 400 Hz to 700 Hz. Examples of various resonance frequencies and their respective configurations are described herein in greater detail.

When the speaker assembly is provided with an electrical signal such as a substantially square wave (generated by, for example, a signal processing circuit), the speaker assembly can be configured to generate an audible signal in response. In certain embodiments, the square wave has a frequency that is also within the above-referenced frequency range of about 400 Hz to 700 Hz. In certain embodiments, the frequency range is about 450 Hz to 600 Hz. In certain embodiments, the frequency range is about 500 Hz to 550 Hz. In certain embodiments, the frequency range is about 510 Hz to 530 Hz. In certain embodiments, the frequency range is about 515 Hz to 525 Hz. In certain embodiments, each of the resonance frequency of the speaker assembly and the frequency of the substantially square wave electrical signal is about 520 Hz. In certain embodiments, the speaker assembly can be configured to have a resonance frequency in one or more of the foregoing ranges. In certain embodiments, both the resonance frequency of the speaker assembly and the frequency of the substantially square wave electrical signal are about 520 Hz.

Figure 11A:
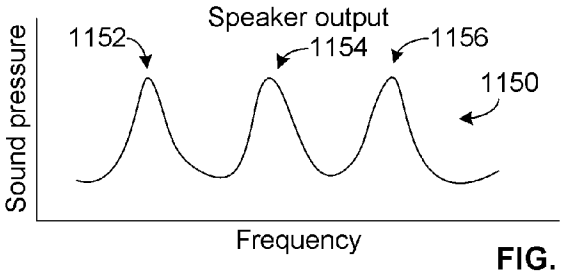
FIG. 11A shows an example sound pressure level (SPL) spectrum that can be generated by some embodiments of the audio speaker of FIG. 10, where the spectrum includes a desired frequency component.
Figure 11B:
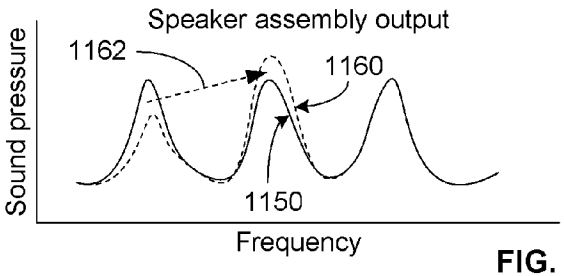
FIGS. 11B and 11C show that in certain embodiments, the speaker assembly of FIG. 10 can be tuned and operated such that a desired portion of the sound pressure level spectrum can be enhanced.
Figure 11C:
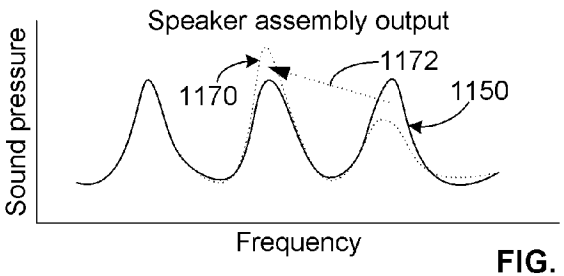

FIGS. 11A-11C show examples of such enhancement of one or more harmonic components. In FIG. 11A, an example frequency spectrum 1150 from the speaker (1130 in FIG. 10) is depicted. Such an audio output spectrum can be expressed in terms of, for example, sound pressure level (SPL). As shown, three example frequency components are indicated as peaks 1152, 1154, and 1156.

In FIG. 11B, an example frequency spectrum 1160 (dashed curve) from the speaker assembly (1000 in FIG. 10) is depicted. In FIG. 11C, another example frequency spectrum 1170 (dotted curve) from the speaker assembly (1000 in FIG. 10) is depicted.

For the purpose of description, suppose that the second peak (1154 in FIG. 9A) represents a desired frequency component that is to be enhanced. In certain embodiments, as shown in FIG. 11B, a desired frequency component can be enhanced (depicted by an arrow 1162) at the expense of one or more lower frequency components. In certain embodiments, as shown in FIG. 11C, a desired frequency component can be enhanced (depicted by an arrow 1172) at the expense of one or more higher frequency components. Various examples of such enhancement are described herein in greater detail. For the purpose of description, a "frequency component" can include a peak typically associated with a fundamental frequency, a harmonic, or a particular range of frequency in a frequency spectrum.

There are a number of ways of configuring the speaker assembly to achieve the foregoing enhancement of a desired frequency component. In various examples, the speaker assemblies are described in the context of a speaker enclosed in an enclosure. Although various examples of the speaker and the enclosure are described as having circular and cylindrical shapes, respectively, it will be understood that other speaker shapes and enclosure shapes are also possible.

Figure 12C:
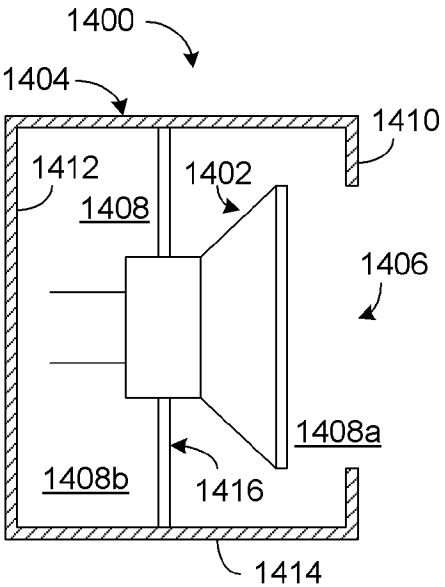
FIGS. 12A-12C show non-limiting examples of how the audio speaker can be coupled to the enclosure so as to form the speaker assembly of FIG. 10.
Figure 12B:
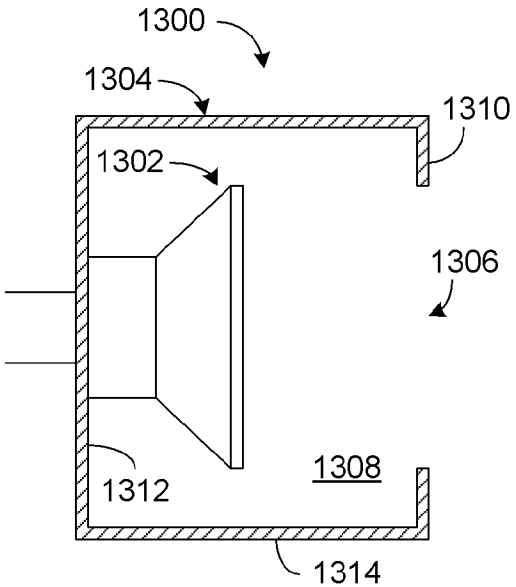
Figure 12A:
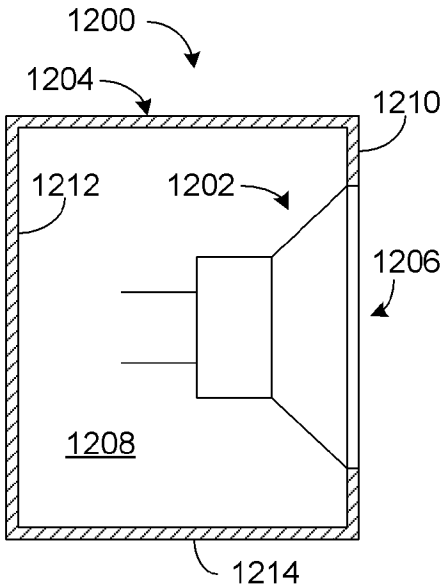

FIGS. 12A-12C show non-limiting examples of the speaker assembly that can be configured to facilitate enhancement of a desired frequency component. In certain embodiments as shown in FIG. 12A, a speaker assembly 1200 can include a speaker 1202 mounted to a front wall 1210 of an enclosure 1204. The front wall 1210 defines an opening 1206 dimensioned to allow passage of sound waves from the speaker 1202. The enclosure 1204 further includes a side wall 1214 that couples the front wall 1210 to a rear wall 1212. The enclosure 1204 thus defines an enclosure volume 1208 that is generally behind the speaker 1202. Examples of resonance and frequency component enhancement are described herein in greater detail.

In certain embodiments as shown in FIG. 12B, a speaker assembly 1300 can include a speaker 1302 mounted to a rear wall 1312 of an enclosure 1304. The enclosure 1304 further includes a side wall 1314 that couples the rear wall 1312 to a front wall 1310. The front wall 1310 defines an opening 1306 dimensioned to allow passage of sound waves from the speaker 1302. The enclosure 1304 thus defines an enclosure volume 1308 that is generally in front of the speaker 1302.

Examples of resonance and frequency component enhancement are described herein in greater detail.

In certain embodiments as shown in FIG. 12C, a speaker assembly 1400 can include an enclosure 1404 having a side wall 1414 that couples a front wall 1410 to a rear wall 1412 so as to define an enclosure volume 1408. A speaker 1402 can be positioned within the enclosure 1404 such that a portion 1408*a* of the enclosure volume 1408 is in front of the speaker 1402, and a portion 1408*b* behind the speaker 1402. The front wall 1410 defines an opening 1406 dimensioned to allow passage of sound waves from the speaker 1402. In the example shown, the speaker 1402 is mounted to the side wall 1404 via mounting structures (e.g., web-like extensions from the side wall to the speaker). It will be understood that speaker 1402 can also be mounted to the front wall 1410, the rear wall 1412, or some combination thereof, by appropriate mounting structures.

Figure 13B:
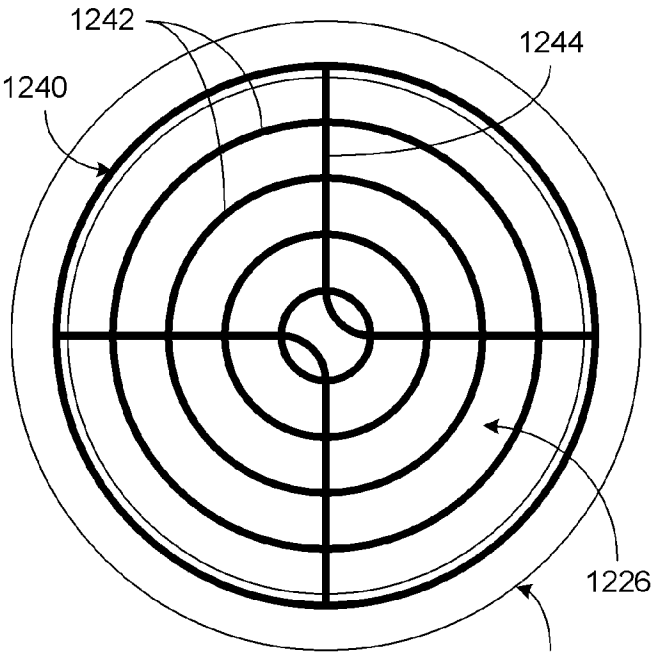
FIGS. 13A and 13B show side cutaway and front views of an example speaker assembly where the speaker is coupled to a front portion of the enclosure.
Figure 13A:
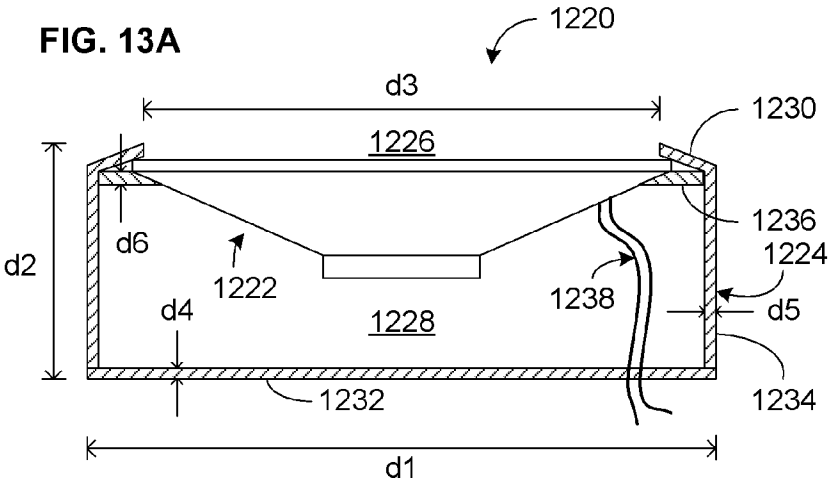

FIG. 13A shows an example speaker assembly 1220 having the front-mounted configuration described in reference to FIG. 12A. FIG. 13B shows a front view of the speaker assembly 1220. The speaker assembly 1220 includes a speaker 1222 mounted to a front wall 1230 of an enclosure 1224. The mounting can be achieved by, for example, a bezel 1236 that secures the rim portion of the speaker 1222 to the back side of the front wall 1230. The front wall 1230 is shown to have an angled profile and defining an opening 1226.

The enclosure 1224 further includes a side wall 1234 that couples the front wall 1230 to a rear wall 1232. The side wall 1234 in this example enclosure 1224 has a cylindrical shape, and the rear wall 1232 is a substantially flat and circular plate. The enclosure 1224 thus defines an enclosure volume 1228 that is generally behind the speaker 1222.

In the example speaker assembly 1220, electrical signals to the speaker 1222 can be delivered via lead wires 1238. The wires 1238 can be routed through the enclosure in a number of ways. For example, the wires can be routed through a hole formed on the rear wall 1232; and the hole can be sealed to inhibit passage of air.

In the example speaker assembly 1220, a protective grill 1244 can be provided to protect the speaker 1222 from external objects while allowing passage of sound waves. In the example shown (FIG. 13B), the protective grill 1244 includes a number of generally concentric rings 1242 joined via members 1244.

Various dimensions are depicted in FIG. 13A. Variations in one or more of such dimensions can have an effect on resonance frequency(ies) of the speaker assembly 1220. Further, different shapes and/or different materials of the parts of the speaker assembly can also affect the resonance frequency (ies).

Figure 14:
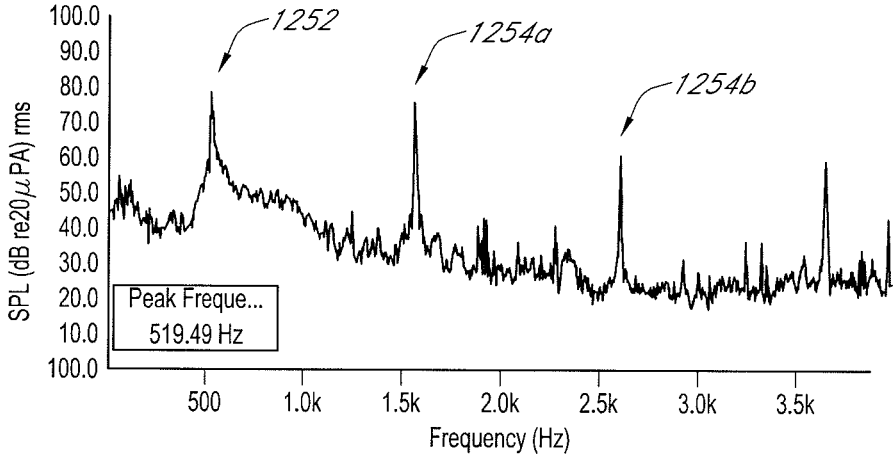
FIG. 14 shows by way of a sound pressure level spectrum that the example speaker assembly of FIG. 13A has a fundamental resonance frequency of about 520 Hz.

FIG. 14 shows a sound pressure level spectrum 1250 for a particular example configuration of the speaker assembly 1220 of FIGS. 13A and 13B. Table 1 lists various parameters of the speaker assembly 1220 that yields the example spectrum 1250.

TABLE 1

| | |
|---|---|
| d1 (rear wall diameter) | Approximately 3.495 in. |
| d2 (enclosure length) | Approximately 1.450 in. |
| d3 (front wall opening diameter) | Approximately 2.765 in. |
| d4 (rear wall thickness) | Approximately 0.100 in. |
| d5 (side wall thickness) | Approximately 0.115 in. |
| d6 (bezel thickness) | Approximately 0.125 in. |
| Enclosure material | PVC (polyvinyl chloride) |
| Enclosure assembly procedure | Separate rear wall plate secured to the side wall with adhesive |

TABLE 1-continued

| | |
|---|---|
| Enclosure volume (without speaker) | Approximately 175 $cm^3$ |
| Speaker type | IDT, 2 W, 8 Ω |
| Speaker diameter | Approximately 3 in. |
| Assembly resonance measurement | Rear wall struck lightly with a finger tip or plastic stylus; and the resulting sound recorded via a microphone placed in front of the speaker enclosure at a distance of 1 to 3 inches. FFT spectral analysis performed on the recorded data. |

In FIG. 14, the spectrum 1250 is shown to include a fundamental resonance frequency of about 519.49 Hz. Additionally, various harmonics indicated as 1254*a*, 1254*b* are present.

Figure 15B:
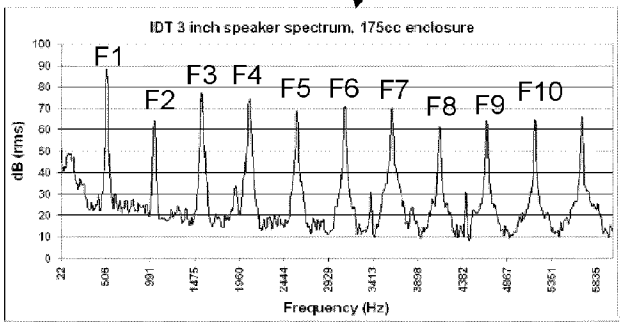
FIG. 15B shows a sound pressure level spectrum of an output from the example speaker assembly of FIG. 18A when the enclosed speaker is driven by the same square waveform as that of FIG. 15A.
Figure 15A:
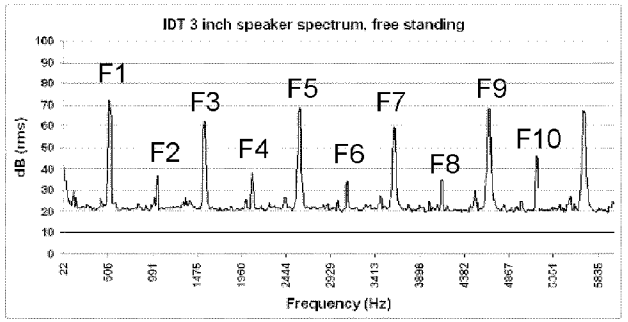
FIG. 15A shows a sound pressure level spectrum of an output from the example speaker of FIG. 13A when free standing (e.g., unenclosed) and driven by a square waveform at approximately 520 Hz.
Figure 16:
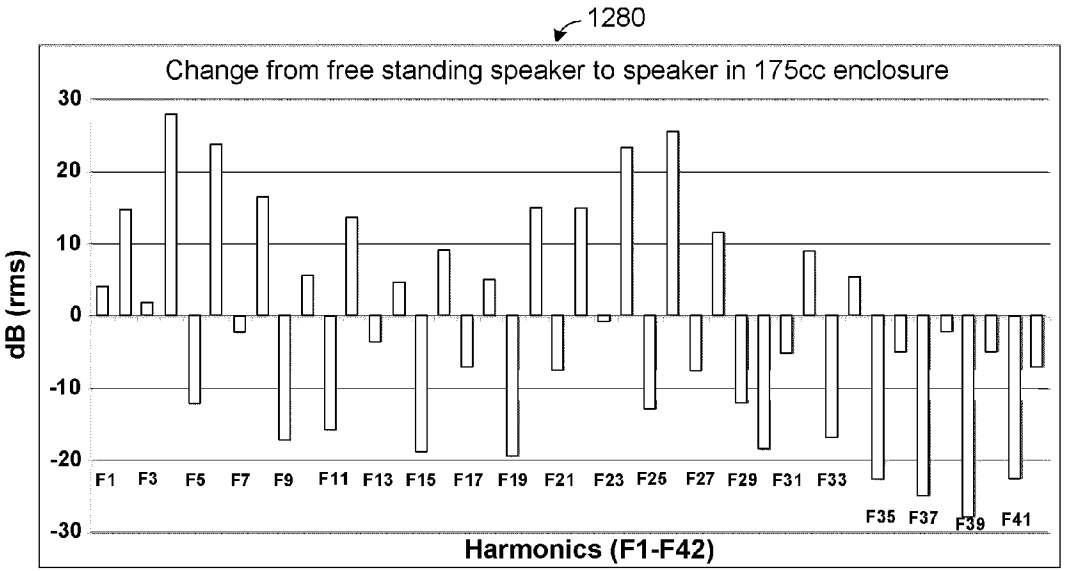
FIG. 16 shows increases and decreases in various harmonics due to one or more effects (e.g. energy transfer) provided by the enclosure when the SPLs of FIGS. 15A and 15B are compared.

When the speaker assembly 1220 of FIGS. 13 and 14 is provided with a square wave input signal of an approximately 515 Hz, a sound pressure level spectrum 1270 shown in FIG. 15B can be obtained by recording the sound (approximately 85 dBA) at a distance of 10 feet. An FFT spectral analysis is performed on the resulting recorded data. In comparison, a sound pressure level spectrum 1260 in FIG. 15A represents measurement of sound output from a free standing speaker (1222 in FIG. 13A) without the enclosure 1224. The difference between the two spectral analyses at each harmonic, obtained by subtracting the free standing speaker spectrum value from the enclosed speaker spectrum value, is shown in FIG. 16, where some energy transfer occurs from higher frequencies (e.g. F5, F9, F11 etc) to lower frequencies (F1, F2, F4 etc). Frequencies above F25 also visibly contribute energy to lower harmonics.

In the example spectra 1260 and 1270 of FIGS. 15A and 15B, the fundamental frequency is identified as being about 516 Hz and indicated as F1. Various harmonics indicated as F2, F3, etc. are also identified. As is generally known, existence of significant harmonics can indicate less than ideal operating conditions associated with a speaker. For example, existence of odd harmonics can indicate one or more drag effects experienced during movements of the diaphragm. Existence of even harmonics can indicate non-uniform magnetic field in the voice coil gap and/or some obstruction in the gap.

With respect to the free standing speaker spectrum 1260, it is noted that prominent odd harmonics (F3, F5, etc.) are manifested. In particular, the fifth harmonic (F5) at about 2580 Hz is nearly as intense as the fundamental frequency (F1).

With respect to the speaker assembly spectrum 1270, it is noted that the intensities of some frequency components are enhanced, while for some frequency components their intensities are reduced. Such enhancements and reductions in frequency components are represented in the differences 1280 shown in FIG. 16, and also listed in Table 2 in dB. Positive values indicate enhancement; negative values indicate attenuation.

TABLE 2

| Harmonic | Change in SPL |
|---|---|
| F1 | 4.1 |
| F2 | 14.8 |
| F3 | 2.0 |
| F4 | 27.9 |
| F5 | −12.1 |
| F6 | 23.6 |
| F7 | −2.2 |

TABLE 2-continued

| Harmonic | Change in SPL |
|---|---|
| F8 | 16.5 |
| F9 | −17.2 |
| F10 | 5.7 |
| F11 | −15.8 |
| F12 | 13.6 |
| F13 | −3.6 |
| F14 | 4.7 |
| F15 | −18.7 |
| F16 | 9.2 |
| F17 | −7.0 |
| F18 | 5.1 |
| F19 | −19.4 |
| F20 | 15.1 |
| F21 | −7.6 |
| F22 | 15.0 |
| F23 | −0.7 |
| F24 | 23.3 |
| F25 | −13.0 |
| F26 | 25.6 |
| F27 | −10.0 |
| F28 | 11.5 |
| F29 | −11.9 |
| F30 | −18.5 |
| F31 | −5.3 |
| F32 | 9.0 |
| F33 | −16.9 |
| F34 | 5.3 |
| F35 | −22.7 |
| F36 | −5.0 |
| F37 | −25.0 |
| F38 | −2.1 |
| F39 | −27.8 |
| F40 | −5.0 |
| F41 | −22.6 |
| F42 | −7.0 |

Notably, the fundamental frequency (F1) intensity is increased by approximately 4.1 dB. Such an enhancement, increasing the energy represented by the fundamental (F1) amplitude in the spectrum, could have been achieved, for example, at the expense of F5 which is attenuated by approximately 12 dB.

Figure 17B:
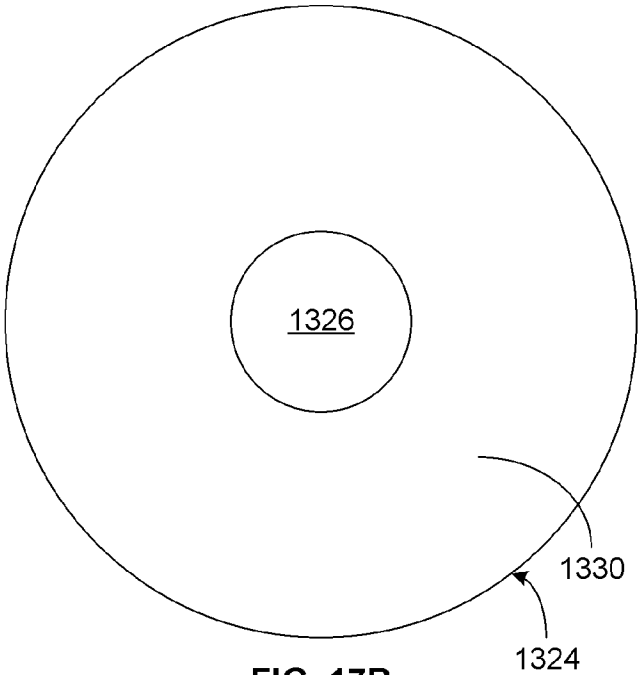
FIGS. 17A and 17B show side cutaway and front views of an example speaker assembly where the speaker is coupled to a rear portion of the enclosure.
Figure 17A:
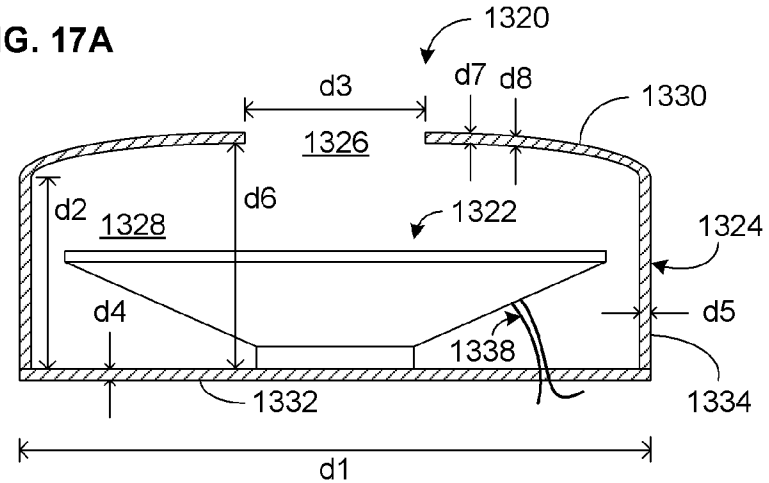

FIG. 17A shows an example speaker assembly 1320 having the rear-mounted configuration described in reference to FIG. 12B. FIG. 17B shows a front view of the speaker assembly 1320. The speaker assembly 1320 includes a speaker 1322 mounted to a rear wall 1332 of an enclosure 1324.

The enclosure 1324 further includes a side wall 1334 that couples the rear wall 1332 to a front wall 1330. The side wall 1334 in this example enclosure 1324 has a cylindrical shape, and the rear wall 1332 is a substantially flat and circular plate. The enclosure 1324 thus defines an enclosure volume 1328 that is generally in front of the speaker 1322.

The front wall 1330 is shown to have a curved dome profile and an opening 1326 of a calculated size. In certain embodiments, the opening 1326 and the enclosure volume 1328 can be dimensioned so as to facilitate Helmholtz effect as described herein.

In the example speaker assembly 1320, electrical signals to the speaker 1322 can be delivered via lead wires 1338. The wires 1338 can be routed through the enclosure in a number of ways. For example, the wires can be routed through an opening formed on the rear wall 1332; and the opening can be sealed to inhibit passage of air.

Various dimensions are depicted in FIG. 17A. Variations in one or more of such dimensions can have an effect on resonance frequency(ies) of the speaker assembly 1320. Further, different shapes and/or different materials of the parts of the speaker assembly can also affect the resonance frequency (ies).

Figure 18:
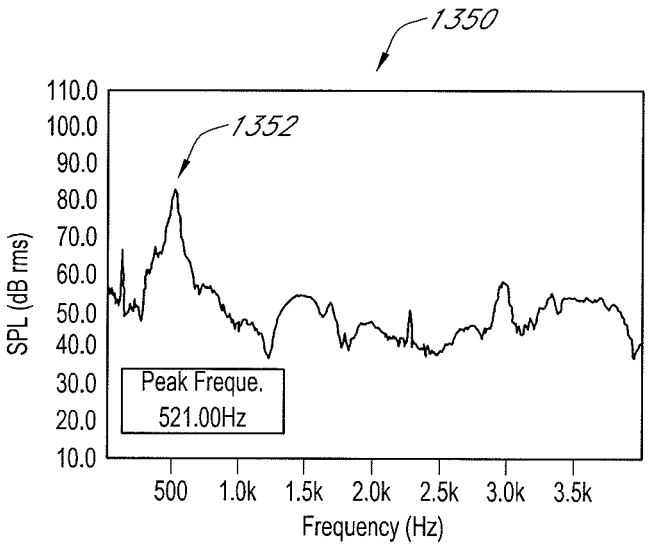
FIG. 18 shows by way of a sound pressure level spectrum that the example speaker assembly of FIG. 17A has a fundamental resonance frequency of about 520 Hz.

FIG. 18 shows a sound pressure level spectrum 1350 for a particular example configuration of the speaker assembly 1320 of FIGS. 17A and 17B. Table 3 lists various parameters of the speaker assembly 1320 that yields the example spectrum 1350.

TABLE 3

| | |
|---|---|
| d1 (rear wall diameter) | Approximately 3.495 in. |
| d2 (enclosure inner length at side wall) | Approximately 1.180 in. |
| d3 (front wall opening diameter) | Approximately 0.690 in. |
| d4 (rear wall thickness) | Approximately 0.100 in. |
| d5 (side wall thickness) | Approximately 0.115 in. |
| d6 (enclosure inner length at opening) | Approximately 0.320 in. |
| d7 (dome thickness near opening) | Approximately 0.100 in. |
| d8 (dome thickness between opening and side wall) | Approximately 0.115 in. |
| Enclosure material | PVC (polyvinyl chloride) |
| Enclosure assembly procedure | Separate rear wall plate with speaker attached secured to the side wall |
| Enclosure volume (without speaker) | Approximately 175 $cm^3$ |
| Speaker type | IDT, 2 W, 8 Ω |
| Speaker diameter | Approximately 3 in. |
| Resonance measurement | Rear wall struck lightly with a finger tip or plastic stylus; and the resulting sound recorded via a microphone placed in front of the speaker enclosure at a distance of 1 to 3 inches. FFT spectral analysis performed on the recorded data. |

Figure 19B:
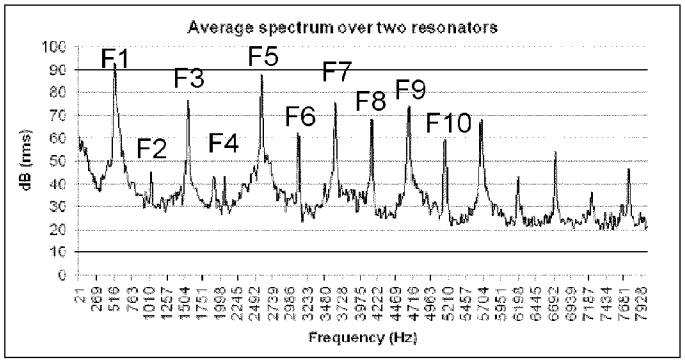
FIG. 19B shows a sound pressure level spectrum of an output from the example speaker assembly of FIG. 17A when the enclosed speaker is driven by the same square waveform as that of FIG. 19A.
Figure 19A:
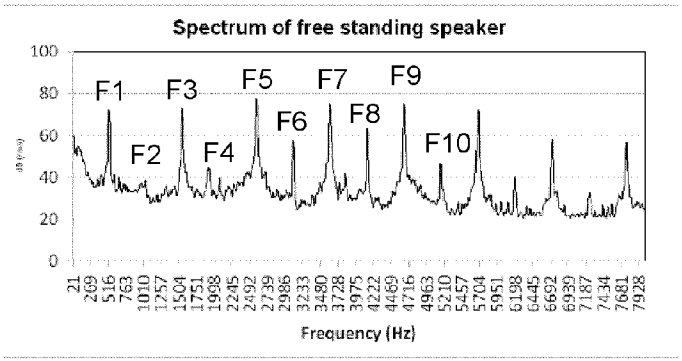
FIG. 19A shows a sound pressure level spectrum of an output from the example speaker of FIG. 17A when free standing (e.g., unenclosed) and driven by a square waveform at approximately 520 Hz.
Figure 20:
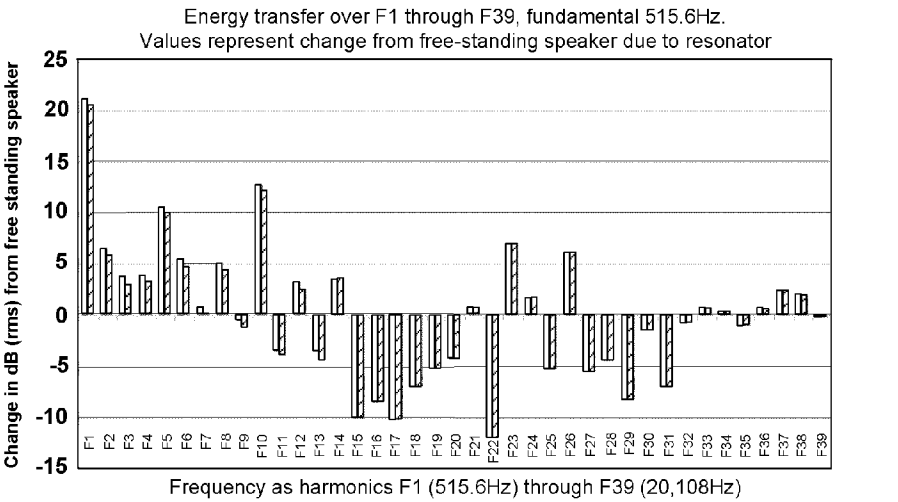
FIG. 20 shows increases and decreases in various harmonics due to one or more effects (e.g. energy transfer) provided by the enclosure when the SPLs of FIGS. 19A and 19B are compared.

In FIG. 18, the spectrum 1350 is shown to include a fundamental resonance frequency of about 521.00 Hz. When speaker assemblies similar to 1320 of FIGS. 17 and 18 are provided with an input signal of an approximately 516 Hz square wave, a sound pressure level spectrum 1370 shown in FIG. 19B can be obtained by recording the sound (approximately 85 dBA) at a distance of approximately 10 feet, and performing an FFT spectral analysis on the recorded data. The example spectrum 1370 shown in FIG. 19B represents an average of two configurations similar to that described in Table 3. In comparison, a sound pressure level spectrum 1360 in FIG. 19A represents measurement of sound output from a free standing speaker (1322 in FIG. 17A) attached to the rear wall 1332 but without the side wall 1334 and the front wall 1330.

In the example spectra 1360 and 1370, the fundamental frequency is identified as being about 520 Hz and indicated as F1. Various harmonics indicated as F2, F3, etc. are also identified. With respect to the free standing speaker spectrum 1360, it is noted that certain odd harmonics (F3, F5, F7, F9) are not only prominent, but are in some cased more dominant than F1. For example, the third (F3) and fifth (F5) harmonics at about 1563 and 2605 Hz have greater power than the 521 Hz fundamental.

With respect to the speaker assembly spectrum 1370, it is noted that the intensities of some frequency components are enhanced considerably, while for some frequency components their intensities are reduced. Such enhancements and reductions in frequency components are represented in a plot 1380 shown in FIG. 20, and also listed in Table 4 for both enclosure volume examples in dB. Positive values indicate enhancement; negative values indicate attenuation.

TABLE 4

| Harmonic | 404 cc enclosure volume | 208 cc enclosure volume |
|---|---|---|
| F1 | 21.1 | 20.4 |
| F2 | 6.6 | 5.9 |
| F3 | 3.7 | 3.0 |
| F4 | 4.0 | 3.3 |
| F5 | 10.6 | 9.9 |
| F6 | 5.5 | 4.8 |
| F7 | 0.8 | 0.2 |
| F8 | 5.1 | 4.4 |
| F9 | −0.6 | −1.3 |
| F10 | 12.7 | 12.0 |
| F11 | −3.5 | −3.9 |
| F12 | 3.3 | 2.6 |
| F13 | −3.5 | −4.4 |
| F14 | 3.5 | 3.6 |
| F15 | −10.0 | −10.1 |
| F16 | −8.5 | −8.5 |
| F17 | −10.2 | −10.2 |
| F18 | −7.1 | −7.1 |
| F19 | −5.2 | −5.2 |
| F20 | −4.3 | −4.3 |
| F21 | 0.8 | 0.8 |
| F22 | −12.0 | −12.0 |
| F23 | 7.1 | 7.1 |
| F24 | 1.7 | 1.7 |
| F25 | −5.3 | −5.3 |
| F26 | 6.2 | 6.2 |
| F27 | −5.6 | −5.6 |
| F28 | −4.4 | −4.4 |
| F29 | −8.3 | −8.3 |
| F30 | −1.5 | −1.5 |
| F31 | −7.1 | −7.1 |
| F32 | −0.8 | −0.7 |
| F33 | 0.7 | 0.7 |
| F34 | 0.3 | 0.4 |
| F35 | −1.1 | −1.1 |
| F36 | 0.6 | 0.7 |
| F37 | 2.4 | 2.4 |
| F38 | 2.1 | 2.0 |
| F39 | −0.3 | −0.2 |

Notably, the fundamental frequency (F1) intensity is increased significantly by approximately 20.8 dB (average of the two resonators), showing transfer of energy to the fundamental at the expense of one or more higher harmonics.

As described herein, there are a number of design parameters that can influence a speaker assembly's resonance properties and/or desired enhancement properties. Dimensions of the enclosure, type of material, and arrangement of various parts are non-limiting examples of such parameters.

FIGS. 21-24 show an example of how variation of one of such parameters can influence the performance of the speaker assembly. In the example, length of the enclosure is varied, and of the effect on frequency enhancements is considered. It will be understood that other parameters can be varied in a similar controlled manner.

Figure 21B:
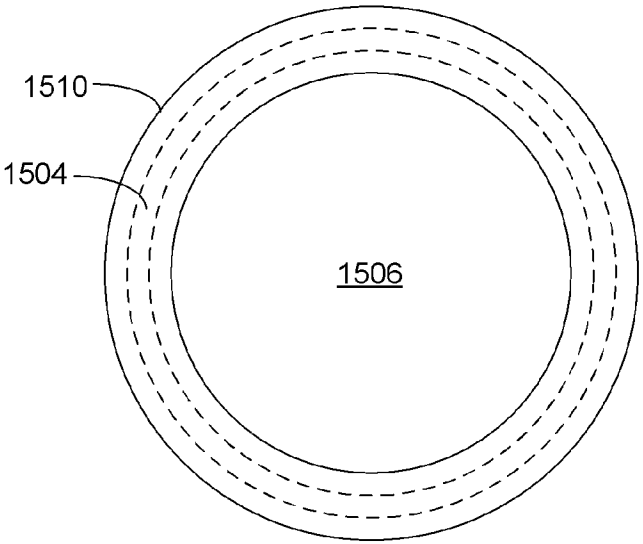
FIGS. 21A and 21B show side cutaway and front views of an example speaker assembly that is similar to the example of FIGS. 13A and 13B, where the speaker is coupled to a front portion of the enclosure.
Figure 21A:
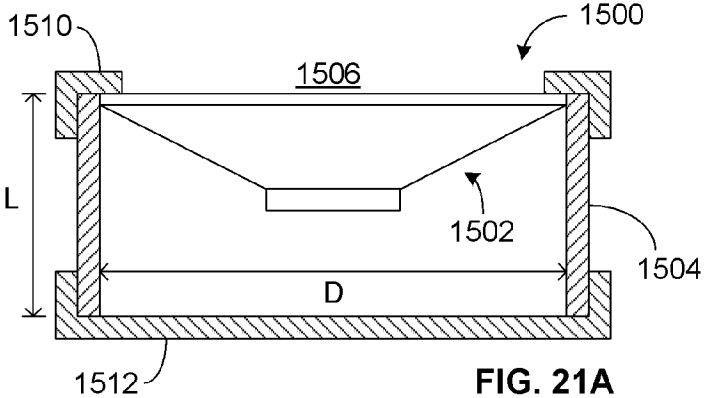

For the purpose of considering the effect of enclosure length, and as shown in FIGS. 21A (side view) and 21B (front view), a front-mounted speaker arrangement (similar to that of FIG. 12A) is used. As shown in FIG. 21A, a speaker assembly 1500 includes a front cap that defines a front wall 1510 with an opening 1506, and a rear cap that defines a rear wall 1512. A speaker 1502 is shown to be attached to the inside of the front wall 1510.

The front cap and the rear cap are joined by a side wall 1504 having a length L and an inner diameter D. To facilitate different length side walls, the front cap (with the speaker attached) and the rear cap are attached to the ends of the cylindrical side wall 1504 by friction fitting; and the caps may be removed and transferred to a different length cylinder. The example open ended and cylindrical shaped side walls (formed from PVC) have the inner diameter D of about 2 inches to accommodate a 2-inch speaker. Seven samples having different lengths as listed in Table 5 are considered.

TABLE 5

| Enclosure sample | Approximate side wall length |
|---|---|
| 1 | 2.545 in. |
| 2 | 2.395 in. |
| 3 | 2.250 in. |
| 4 | 2.100 in. |
| 5 | 1.946 in. |
| 6 | 1.795 in. |
| 7 | 1.648 in. |

Figure 22:
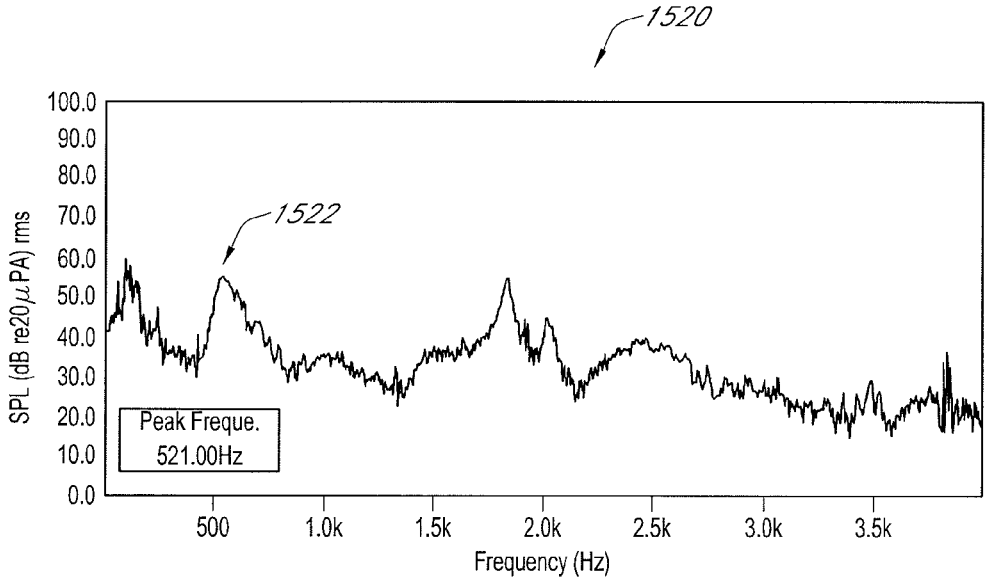
FIG. 22 shows by way of a sound pressure level spectrum that the example speaker assembly of FIG. 21A has a fundamental resonance frequency of about 530 Hz.

FIG. 22 shows a sound pressure level spectrum 1520 for the enclosure sample number 7 identified in Table 5 when its rear wall is struck and response measured in a manner similar to those described in reference to Table 1. The sound pressure level spectrum 1520 is shown to include a fundamental resonance frequency of about 530.33 Hz. It is noted that in the example spectrum 1520, the peak at around 100 Hz is due to a known environmental artifact.

Figure 23A:
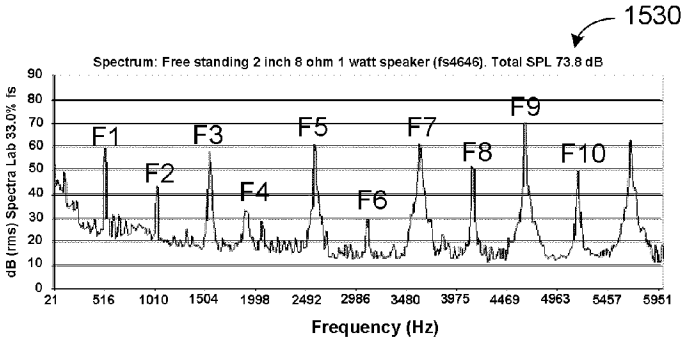
FIG. 23A shows a sound pressure level spectrum of an output from the example speaker of FIG. 21A when free standing (e.g., unenclosed) and driven by a square waveform at approximately 520 Hz.
Figure 23B:
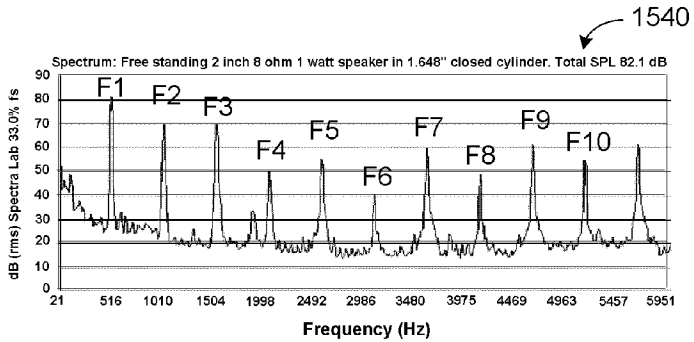
FIG. 23B shows a sound pressure level spectrum of an output from the example speaker assembly of FIG. 21A when the enclosed speaker is driven by the same square waveform as that of FIG. 23A.

When the speaker assembly corresponding to the enclosure sample number 7 identified in Table 5 is provided with an input signal of an approximately 515 Hz square wave, a sound pressure level spectrum 1540 shown in FIG. 23B can be obtained. In comparison, a sound pressure level spectrum 1530 in FIG. 23A represents measurement of sound output from a free standing speaker (1502 in FIG. 21A).

In the example spectra 1530 and 1540, the fundamental frequency is identified as being about 516 Hz and indicated as F1. Various harmonics indicated as F2, F3, etc. are also identified. With respect to the free standing speaker spectrum 1530, it is noted that certain odd harmonics (F3, F5, F7, F9) are not only prominent, but are in some cases represent more acoustic power than F1. For example, the ninth harmonic (F9) at about 4646 Hz is significantly more intense than the fundamental frequency (F1).

Figure 24:
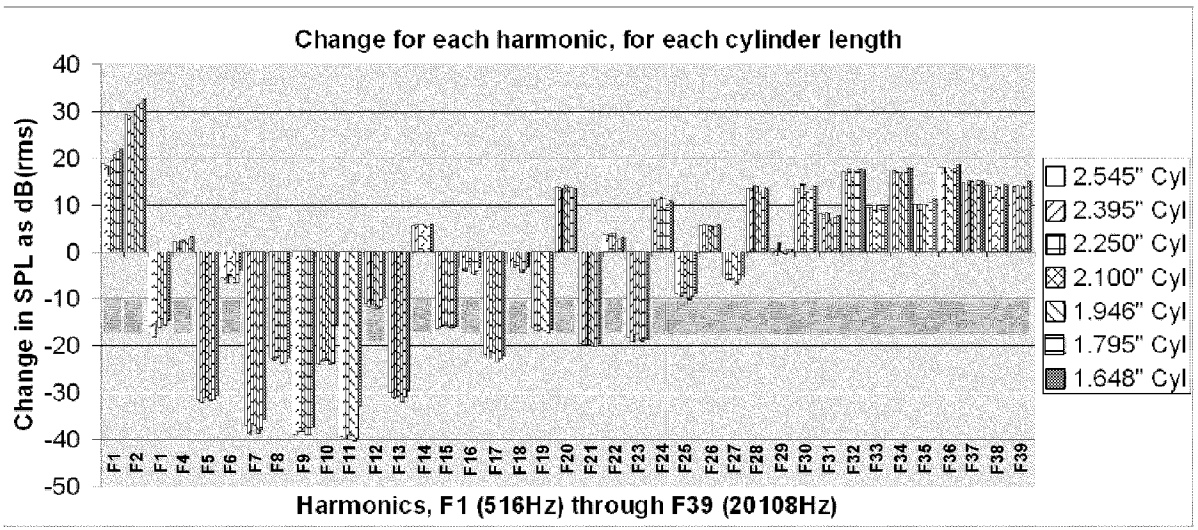
FIG. 24 shows increases and decreases in various harmonics due to one or more effects (e.g. energy transfer) provided by the enclosure when SPLs similar to those

With respect to the speaker assembly spectrum 1540, it is noted that the intensities of some frequency components are enhanced considerably, while for some frequency components their intensities are reduced considerably. Such enhancements and reductions in frequency components are represented for seven different enclosure volumes in differences 1550 shown in FIG. 24, and also listed in Table 6 in dB. Positive values indicate enhancement; negative values indicate attenuation. In FIG. 24, the order of difference bars (from left to right) correspond to the order of cylinder lengths (high to low) indicated on the right legend.

TABLE 6

| Harmonic | 2.545" Cyl | 2.395" Cyl | 2.250" Cyl | 2.100" Cyl | 1.946" Cyl | 1.795" Cyl | 1.648" Cyl |
|---|---|---|---|---|---|---|---|
| F1 | 19 | 18.3 | 15.8 | 19.5 | 20.6 | 21.0 | 21.9 |
| F2 | 29 | 28.8 | 26.3 | 30.1 | 31.1 | 31.5 | 32.3 |
| F3 | −16 | −18.4 | −14.8 | −16.2 | −14.3 | −15.8 | −14.7 |

TABLE 6-continued

| Harmonic | 2.545" Cyl | 2.395" Cyl | 2.250" Cyl | 2.100" Cyl | 1.946" Cyl | 1.795" Cyl | 1.648" Cyl |
|---|---|---|---|---|---|---|---|
| F4 | 2 | 0.8 | 2.0 | 2.3 | 1.9 | 2.7 | 3.2 |
| F5 | −32 | −32.2 | −31.1 | −31.1 | −31.6 | −31.5 | −30.7 |
| F6 | −6 | −6.8 | −5.1 | −5.1 | −6.6 | −6.4 | −4.1 |
| F7 | −37 | −39.1 | −36.7 | −37.0 | −38.7 | −37.9 | −35.8 |
| F8 | −23 | −23.1 | −22.5 | −22.4 | −23.7 | −23.6 | −22.7 |
| F9 | −39 | −38.4 | −38.3 | −38.2 | −39.1 | −39.1 | −37.4 |
| F10 | −24 | −23.2 | −23.0 | −23.1 | −24.1 | −23.8 | −15.9 |
| F11 | −39 | −39.8 | −39.0 | −39.2 | −40.4 | −39.8 | −32.9 |
| F12 | −11 | −11.8 | −11.0 | −10.6 | −12.2 | −11.6 | −9.7 |
| F13 | −30 | −31.0 | −30.9 | −30.7 | −31.9 | −30.9 | −29.7 |
| F14 | 5 | 5.6 | 5.7 | 5.6 | 5.2 | 5.3 | 5.7 |
| F15 | −16 | −16.1 | −15.8 | −15.8 | −16.4 | −16.3 | −16.0 |
| F16 | −3 | −4.3 | −3.4 | −3.0 | −4.9 | −4.3 | −3.3 |
| F17 | −22 | −22.8 | −21.6 | −21.6 | −23.4 | −23.0 | −22.2 |
| F18 | −3 | −3.3 | −2.9 | −2.5 | −4.6 | −4.1 | −3.1 |
| F19 | −16 | −16.9 | −16.7 | −16.5 | −17.0 | −17.2 | −16.6 |
| F20 | 14 | 13.1 | 13.3 | 14.0 | 13.6 | 13.5 | 13.4 |
| F21 | −19 | −19.8 | −19.7 | −19.0 | −20.3 | −20.2 | −19.6 |
| F22 | 3 | 2.8 | 3.6 | 3.9 | 2.1 | 2.7 | 2.9 |
| F23 | −18 | −19.1 | −17.7 | −17.4 | −19.2 | −18.8 | −18.7 |
| F24 | 11 | 8.9 | 11.0 | 11.3 | 8.9 | 9.5 | 10.8 |
| F25 | −9 | −9.5 | −8.8 | −8.6 | −10.3 | −9.5 | −8.8 |
| F26 | 5 | 5.6 | 5.5 | 5.4 | 4.5 | 5.2 | 5.8 |
| F27 | −6 | −6.1 | −5.9 | −6.0 | −6.9 | −5.9 | −5.5 |
| F28 | 14 | 12.7 | 13.8 | 12.5 | 12.2 | 13.3 | 13.4 |
| F29 | 1 | −0.9 | 1.7 | 0.0 | −0.4 | 0.3 | 0.6 |
| F30 | 14 | 12.4 | 14.3 | 12.8 | 12.5 | 13.1 | 13.8 |
| F31 | 8 | 7.1 | 8.2 | 6.8 | 7.3 | 7.3 | 7.8 |
| F32 | 17 | 16.0 | 17.7 | 15.8 | 17.1 | 17.4 | 17.6 |
| F33 | 9 | 7.5 | 9.8 | 8.6 | 8.8 | 9.5 | 10.0 |
| F34 | 17 | 15.5 | 16.8 | 16.8 | 15.9 | 16.7 | 17.7 |
| F35 | 10 | 8.9 | 10.2 | 9.8 | 9.1 | 10.3 | 11.3 |
| F36 | 18 | 16.5 | 17.9 | 17.3 | 16.7 | 17.8 | 18.5 |
| F37 | 15 | 12.9 | 14.9 | 13.8 | 14.2 | 14.9 | 14.9 |
| F38 | 14 | 13.0 | 13.8 | 12.9 | 13.6 | 13.9 | 14.2 |
| F39 | 14 | 12.9 | 13.9 | 13.9 | 13.6 | 13.8 | 15.0 |

Notably, the fundamental frequency (F1) energy is increased significantly by approximately between 15.8 dB to 21.9 dB (among the seven different length enclosures). Conversely, the energy content of F5 through F13 were greatly reduced, representing a transfer of energy from higher to lower frequencies by one or more effects provided by the enclosure design.

While it is not desired or intended to be bound by any particular theory, some observations can be made from measurements from the various examples described in reference to FIGS. 13-16 (front mounted speaker), 17-20 (rear mounted speaker), and 21-24 (front mounted speaker with varying enclosure lengths). In certain embodiments, various enhancements of the fundamental frequency component and some lower harmonics, and attenuation of higher harmonics, may be attributable to interference effect, resonance effect, Helmholtz effect, or some combination thereof.

For example, interference effect can be manifested when a first wave is emitted from the front of a speaker (e.g., when the diaphragm moves forward), and a second wave is emitted from the rear of the speaker (e.g., when the diaphragm moves backward). The second wave can reflect from the rear wall and propagate forward and through the diaphragm, such that the second wave has a shift in phase relative to the first wave. The first and second waves can interfere constructively or destructively, depending on the phase shift.

In another example, resonance effect can enhance the fundamental frequency (F1) of a speaker assembly's output by virtue of the input signal frequency being the same or close to the speaker assembly's resonance frequency. More particularly, vibration of the speaker at the input frequency can induce resonance of the speaker assembly, which in turn emits sound at the resonance frequency to enhance the intensity of F1.

In another example, Helmholtz effect can be manifested via resonance of air in a cavity with an opening through a neck. Typically, frequency of resonance due to Helmholtz effect ($f_H$) depends on speed of sound of gas (v), cross-sectional area of the neck (A), length of the neck (L), and volume of the cavity ($V_o$) as $f_H=(v/(2\pi))\mathrm{sqrt}(A/(V_oL))$. In the examples described herein, the speaker assembly 1320 described in reference to FIGS. 17-20 can exhibit Helmholtz effect due to the presence of air volume 1328 between the speaker 1322 and the neck opening 1326.

The speaker assembly 1220 (FIGS. 13-16) and the speaker assembly 1320 (FIGS. 17-20) have similar shaped enclosure and overall dimensions, with primary differences being in speaker placement and opening size on the front wall. The speaker assembly 1220 has the speaker mounted on the front wall. Although there is some air volume associated with the speaker's cone diaphragm, the speaker assembly 1220 likely does not exhibit a Helmholtz effect due to lack of a neck typically associated with the Helmholtz effect. On the other hand, the speaker assembly 1320 has the speaker mounted on the rear wall; and thus provides a larger air volume in front of the speaker. Further, the opening formed on the front wall can act as a neck to facilitate a Helmholtz effect. For both speaker assemblies 1220 and 1320, contributions to the enhancement of F1 due to resonance and interference are likely possible.

Observations in view of the foregoing are summarized in Table 7.

TABLE 7

| | Speaker on front wall | Speaker on rear wall |
|---|---|---|
| Resonance effect | Yes | Yes |
| Interference effect | Yes | Yes |
| Helmholtz effect | No | Yes |
| F1 SPL for speaker | 84.8 dB | 72.2 dB |
| F1 SPL for speaker assembly | 88.9 dB | 92.7 dB |
| Relative enhancement | 4.8% | 28.4% |

Table 7 shows that a Helmholtz effect may contribute significantly in embodiments (e.g., speaker assembly of FIGS. 17-20) where air resonance is facilitated.

Data associated with the example speaker assembly 1500 (FIGS. 21-24) can provide some insight into the interference effect. The speaker assembly 1500 has the speaker mounted on the front wall, and the front wall is separated from the rear wall with different lengths. As listed in Table 6 and shown in FIG. 24, the enhancement of F1 generally increases as the cylindrical wall length decreases. This trend is consistent with what can be expected in the interference scenario.

For example, it is generally known that an intensity (I) of a wave resulting from two interfering waves (each having intensity amplitude $I_o$) is proportional to $I_o \cos^2(\pi\Delta x/\lambda)$, where $\Delta x$ represents path length difference contributing to the phase difference and $\lambda$ is the wavelength. Such an expression assumes that both waves are sinusoidal and have the same wavelength. In the context of the example speaker assembly 1500 (FIGS. 21-24), $\Delta x$ can be approximated as 2L. Also, for the fundamental frequency F1 (516 Hz), the corresponding $\lambda$ is approximately 66.5 cm (assuming speed of sound to be about 343 m/s).

For the range of enclosure lengths of the seven examples listed in Tables 5 and 6 (about 4.18 cm to 6.46), the term $\cos^2(\pi\Delta x/\lambda)=\cos^2(2\pi L/\lambda)$ increases as the length L decreases. Further, in the context of the example rear-wall mounted speaker configuration, path length difference $\Delta x$ in $\cos(\pi\Delta x/\lambda)$ can be thought of as being even smaller due to the close proximity of the diaphragm to the rear wall. In such a situation where $\Delta x \ll \lambda$, the $\cos^2(\pi\Delta x/\lambda)$ approaches a maximum value. Thus, the example speaker assembly 1320 of FIGS. 17-20 may benefit from interference effect in addition to Helmholtz effect.

Figure 25:
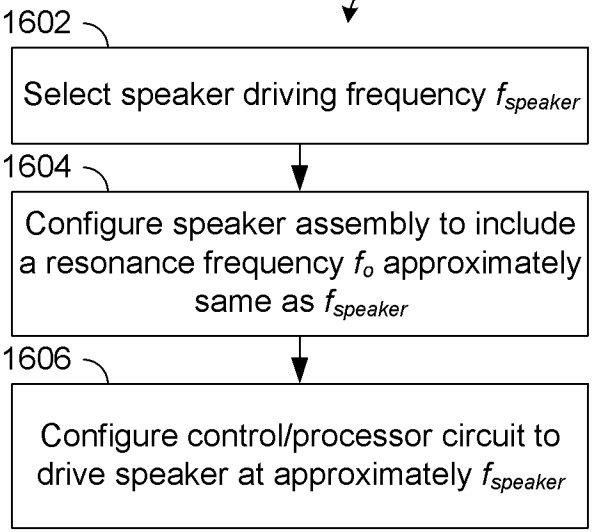
FIG. 25 shows a process that can be implemented for configuring a hazardous condition detection device such as a smoke detector or a carbon monoxide detector.

As described herein, a speaker assembly can be configured to output a desired frequency sound at an enhanced intensity. FIG. 25 shows a process 1600 that can be implemented to facilitate achievement of such enhanced sound. In block 1602, a speaker driving frequency ($f_{speaker}$) can be selected. In certain embodiments, $f_{speaker}$ can be approximately 520 Hz. In certain embodiments, the 520 Hz signal can be a square wave signal. In block 1604, a speaker assembly can be configured to include a resonance frequency $f_o$ that is the same or close to $f_{speaker}$. In certain embodiments, the $f_o$ can differ from $f_{speaker}$ by less than about 10%, 5%, 2%, or 1%. In block 1606, a control/processor circuit can be configured to drive the speaker at approximately $f_{speaker}$.

Figure 26:
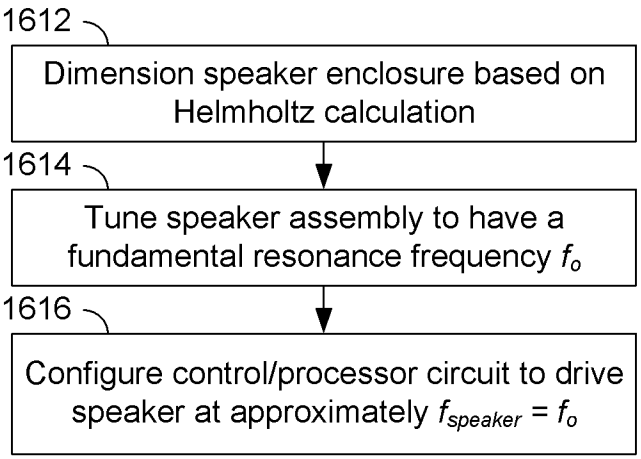
FIG. 26 shows a process that can be implemented for configuring a speaker assembly of the hazardous condition detection device of FIG. 25 so as to include an air resonance effect.

As described herein, a speaker assembly can be configured to include air resonance effect and/or interference effect. Thus, one or more of such effects can be incorporated during configuration of the speaker assembly. FIG. 26 shows a process 1610 that can be implemented to facilitate air resonance effect in a speaker assembly. In block 1612, a speaker enclosure can be dimensioned based on Helmholtz calculation. Further, placement of the speaker in the enclosure can be selected so as to provide sufficient cavity volume to facilitate the air resonance effect. In block 1614, the speaker assembly having the speaker enclosure of block 1612 can be tuned to have a fundamental resonance frequency $f_o$, such as that of block 1604 of FIG. 25. In block 1616, a control/processor circuit can be configured to drive the speaker at $f_{speaker}$ that is the same or close to $f_o$. In certain embodiments, the $f_o$ can differ from $f_{speaker}$ by less than about 10%, 5%, 2%, or 1%.

Figure 28:
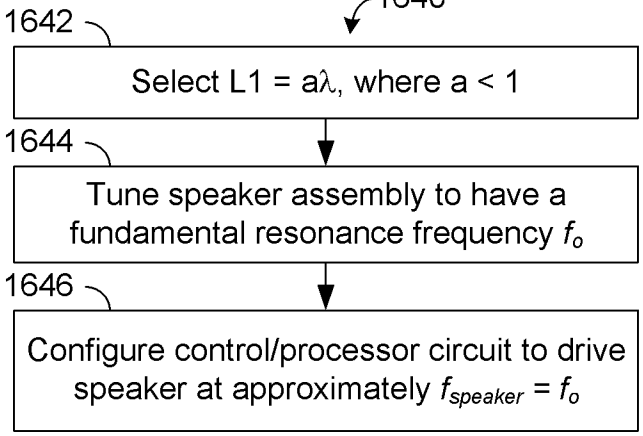
FIG. 28 shows a process that can be implemented for configuring a speaker assembly of the hazardous condition detection device of FIG. 25 so as to include an interference effect facilitated by the speaker position configuration of FIGS. 27A and 27B.
Figure 27A:
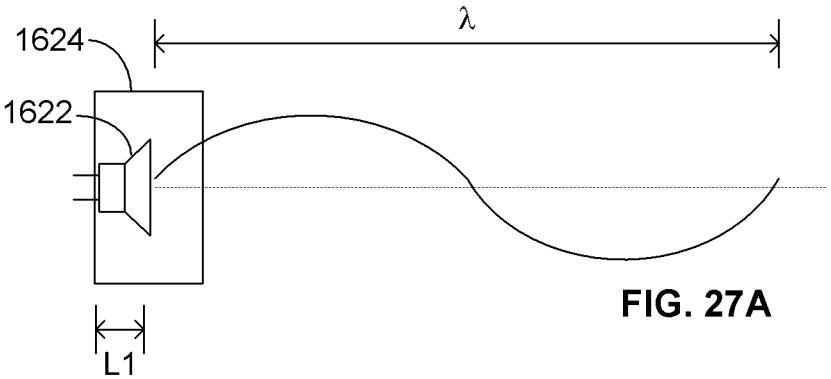
FIGS. 27A and 27B show that in certain embodiments, the configuring process of FIG. 25 can include selecting a speaker position in an enclosure.
Figure 27B:
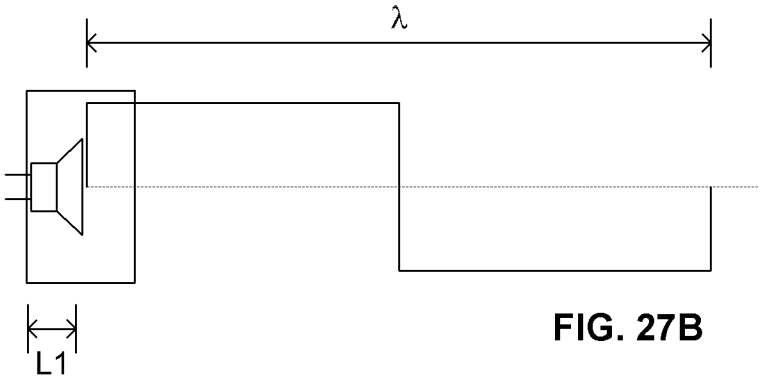

FIG. 28 shows a process 1640 that can be incorporated during configuration of the speaker assembly, in the context of periodic sound output examples depicted in FIGS. 27A (sinusoidal wave example) and 27B (square wave example). In block 1642, a dimension (L1) between a speaker 1622 and a rear wall of an enclosure 1624 can be selected to be less than the wavelength ($\lambda$) of the sound output. In certain embodiments, L1 is less than about (⅛)x$\lambda$, 0.10$\lambda$, or 0.05$\lambda$. In block 1644, the speaker assembly having the speaker placement of block 1642 can be tuned to have a fundamental resonance frequency $f_o$, such as that of block 1604 of FIG. 25. In block 1646, a control/processor circuit can be configured to drive the speaker at $f_{speaker}$ that is the same or close to $f_o$. In certain embodiments, the $f_o$ can differ from $f_{speaker}$ by less than about 10%, 5%, 2%, or 1%.

In the various non-limiting examples described herein, various enclosures are formed from PVC. It will be understood, however, that any number of different materials and dimensions can be utilized. For example, materials such as sheet metals (having thickness of, for example, about 0.010"), other plastics, or resin impregnated cardboard or paper products can be utilized to achieve one or more features as described herein.

In one embodiment, a speaker/enclosure assembly as described above is incorporated into a ceiling-mounted alarm device, such as a standard-size smoke detector, carbon monoxide detector, combined smoke and carbon monoxide detector, or supplemental alert generator. The enclosure assembly may be fully or partially housed within the housing of the ceiling-mounted alarm device, and is preferably mounted to the housing such that the back wall 1212, 1312, 1412, 1232 of the enclosure is not in contact with any rigid structure other than the side wall of the enclosure. The alarm device may use the speaker/enclosure assembly to efficiently generate an audible square wave alert signal of approximately 520 Hz. Where used to generate such a signal, the speaker/enclosure assembly preferably has a resonant frequency in the range of 450 to 600 Hz or (more preferably) 500 to 550 Hz, and ideally about 520 Hz. The speaker/enclosure assembly may, but need not, be driven by any of the boosted amplifier circuits described above. In the context of such a detector/alert device, the speaker/enclosure assembly advantageously enables a standards and regulation-compliant 520 Hz (approx.) square wave signal to be efficiently generated using a low-cost audio speaker (typically 3" or 2.5" in diameter) and low-cost batteries (e.g., AA batteries). Although low-cost audio speakers commonly have poor low-frequency performance, the assembly advantageously compensates for such poor performance by boosting the speaker's output and modifying the spectrum over a range of desirable lower frequencies.

Conclusion

Conditional language, such as, among others terms, "can," "could," "might," or "may," and "preferably," unless specifically stated otherwise, or otherwise understood within the context as used, is generally intended to convey that certain embodiments include, while other embodiments do not include, certain features, elements and/or steps.

Many variations and modifications can be made to the above-described embodiments, the elements of which are to be understood as being among other acceptable examples. Thus, the foregoing description is not intended to limit the scope of protection.

What is claimed is:

1. A alarm device, comprising:

a detection device configured to detect an alarm condition;

a voltage boost regulator, said voltage boost regulator configured to generate a boosted DC power signal by boosting a DC input voltage from a battery source, said boosted DC power signal having at least a threshold DC voltage associated with a threshold sound intensity;

a non-linear amplifier configured to amplify a signal, said non-liner amplifier powered by the boosted DC power signal generated by the voltage boost regulator;

signal processing circuitry that is configured to receive an alarm condition detection signal from the detection device and in response to the signal, generate an output signal to the non-linear amplifier such that the non-liner amplifier generates an amplified output signal; and a speaker that is configured to receive the amplified output signal from the non-linear amplifier and output an audible alert signal, said speaker comprising a diaphragm driven by a coil.

2. The alarm device of claim 1 wherein the output signal generated by the signal processing circuitry is substantially a square wave with a frequency of approximately 520 Hz.

3. The alarm device of claim 1, wherein the voltage boost regulator regulates a degree of DC voltage boost such that an intensity of the audible alert signal is maintained at a level of at least 85 dBA as measured at 10 feet from the alarm device.

4. The alarm device of claim 1, wherein the signal processing circuitry comprises a microprocessor.

5. The alarm device of claim 1, wherein the voltage boost regulator is configured to boost a DC voltage from two AA batteries to approximately 5.5 volts.

6. The alarm device of claim 1, wherein the alarm condition is the presence of smoke or carbon monoxide.

7. The alarm device of claim 1, further comprising a speaker enclosure structure to which the speaker is mounted, said speaker enclosure structure comprising a cylindrical, tubular section that is sealed at one end with a substantially flat rear wall.

8. The alarm device of claim 7 wherein the threshold voltage is approximately 5.5 V.

9. The alarm device of claim 7 wherein the threshold voltage is approximately 9 V.

10. The alarm device of claim 1, wherein the battery source consists of two AA batteries.

11. The alarm device of claim 1, wherein the battery source consists of four AA batteries.

12. The alarm device of claim 1 wherein the speaker has a diameter in the range of 2.5 to 3 inches.

13. The alarm device of claim 1 wherein the speaker has a diameter of approximately 2.5 inches.

14. The alarm device of claim 1 wherein the speaker has a diameter of approximately 3 inches.

15. The alarm device of claim 1 wherein the speaker has a diameter of approximately 4 inches.

16. The alarm device of claim 1 further comprising an enclosure structure that is attached to the speaker to form a sealed speaker enclosure.

17. The alarm device of claim 1 wherein the non-linear amplifier is a Class D audio amplifier.

18. The alarm device of claim 1, wherein the speaker is mounted to a speaker enclosure to form a speaker assembly, said speaker assembly having a fundamental resonance frequency in the range of 400 to 700 Hz.

19. The alarm device of claim 18, wherein the output signal supplied to the non-linear amplifier has a fundamental frequency in said range of 400 to 700 Hz.

20. The alarm device of claim 19, wherein the output signal is a square wave signal.

21. The alarm device of claim 18, wherein the audible alert signal resulting from the speaker assembly has a boosted intensity at the fundamental frequency, said boosted intensity resulting at least partly from a transfer of energy from one or more harmonics of the amplified output signal to a fundamental frequency of the amplified output signal.

22. The alarm device of claim 1, wherein the alarm condition comprises an audio signal from a separate alarm device, and the detection device is configured to detect the audio signal from the separate alarm device.

23. The alarm device of, claim 1, wherein the amplified output signal has a fundamental frequency in the range of 400 to 700 HZ and multiple harmonics, and the speaker is coupled to a speaker enclosure to form a sealed speaker enclosure assembly, said sealed speaker enclosure assembly configured to transfer energy downward in frequency from at least one of said harmonics to the fundamental frequency.

24. An alarm device, comprising:

a detection device configured to detect an alarm condition;

a voltage boosted regulator configured to convert a DC input voltage from a battery source to a DC output voltage that is higher than the DC input voltage;

circuitry configured to generate an audio alarm signal in response to the detection device detecting an alarm condition, said audio alarm signal having a fundamental frequency in the range of 400 to 700 Hz and having multiple harmonics;

a non-liner amplifier configured to receive and amplify the audio alarm signal, said non-liner amplifier powered by the DC output voltage from the voltage boost regulator; and an audio speaker coupled to the nonlinear amplifier such that the audio speaker converts the amplified alarm signal into corresponding sound waves, said audio speaker having a diaphragm that is driven by a coil.

25. The alarm device of claim 24, wherein the voltage boost regulator is configured to regulate a degree of DC voltage boost such that on intensity of the sound waves is maintained at a level of at least 85 dBA as measured at 10 feet from the alarm device.

26. The alarm device of claim 24, wherein the voltage boost regulator is configured to boost a DC voltage from two AA batteries to approximately 5.5 volts.

27. The alarm device of claim 24, wherein the audio speaker is mounted to a sealed speaker enclosure structure that is configured to boost an audio output at said fundamental frequency.

28. The alarm device of claim 27, wherein the sealed speaker enclosure structure comprises a cylindrical, tubular section that is sealed at one end with a substantially flat rear wall.

29. The alarm device of claim 27, wherein the sealed speaker enclosure structure is configured to boost said audio output, at least in part, by transferring energy downward in frequency from at least one of said harmonics to the fundamental frequency.

30. The alarm device of claim 27, wherein the audio speaker and sealed speaker enclosure structure collectively have a resonance frequency in said range of 400 to 700 Hz, said resonance frequency being dependent upon dimensions of the sealed speaker enclosure structure.

31. The alarm device of claim 24, wherein the audio speaker has a diameter of approximately three inches.

32. The alarm device of claim 24, wherein the fundamental frequency of the audio alarm signal is approximately 520 Hz.

33. The alarm device of claim 24, wherein the audio alarm signal is approximately a square wave signal.

34. The alarm device of claim 24, wherein the non-liner amplifier is a Class D audio amplifier.

35. The alarm device of claim 24, further comprising a circuit that controls the voltage boost regulator.

* * * * *